US012344417B2

(12) United States Patent
Holmes

(10) Patent No.: US 12,344,417 B2
(45) Date of Patent: Jul. 1, 2025

(54) AUTOMATIC PACKAGER FOR MEDICAL PRODUCTS

(71) Applicant: RXSAFE LLC, Vista, CA (US)

(72) Inventor: William K. Holmes, San Diego, CA (US)

(73) Assignee: RXSAFE LLC, Vista, CA (US)

( * ) Notice: Subject to any disclaimer, the term of this patent is extended or adjusted under 35 U.S.C. 154(b) by 159 days.

(21) Appl. No.: 17/800,567

(22) PCT Filed: Feb. 18, 2021

(86) PCT No.: PCT/US2021/018554
§ 371 (c)(1),
(2) Date: Aug. 18, 2022

(87) PCT Pub. No.: WO2021/168095
PCT Pub. Date: Aug. 26, 2021

(65) Prior Publication Data

US 2023/0138334 A1 May 4, 2023

Related U.S. Application Data

(60) Provisional application No. 62/978,174, filed on Feb. 18, 2020.

(51) Int. Cl.
*B65B 5/06* (2006.01)
*B65B 5/02* (2006.01)
*B65B 5/10* (2006.01)

(52) U.S. Cl.
CPC ..... *B65B 5/02* (2013.01); *B65B 5/06* (2013.01); *B65B 5/103* (2013.01)

(58) Field of Classification Search
USPC ..... 53/52
See application file for complete search history.

(56) References Cited

U.S. PATENT DOCUMENTS 4,697,721 A * 10/1987 Johnson ..... B65B 57/20 221/241
5,704,516 A 1/1998 Yuyama
(Continued)

FOREIGN PATENT DOCUMENTS

EP 1676778 A1 7/2006
EP 3459517 A1 3/2019
(Continued)

OTHER PUBLICATIONS

International Search Report with Written Opinion for the related Application No. PCT/US2021/018554 dated May 4, 2021 (15 Pages).
(Continued)

*Primary Examiner* — Chinyere J Rushing-Tucker
(74) *Attorney, Agent, or Firm* — Michael Best & Friedrich LLP

(57) ABSTRACT

Embodiments herein provide an automatic packager (100) for medical products. One embodiment provides an automatic packager (100) including a universal feed cassette (105) and a packaging unit (110). The universal feed cassette (105) includes a plurality of cartridge slots (130) to receive cartridges (155). Each cartridge (155) includes a reservoir (170) for storing a plurality of medical products and a wheel (180) including a bottom portion placed in the reservoir (170). The wheel (180) rotatable with respect to the reservoir (170). Each cartridge (155) also includes a scooping member (185) provided on the wheel (180) to rotate with the wheel (185) and singulate a medical product from the reservoir (170), and a funnel extension (175) coupled to the reservoir (170) and extending outward and upward from the reservoir (170).

31 Claims, 28 Drawing Sheets

(56) References Cited

U.S. PATENT DOCUMENTS

| | | | | |
|---|---|---|---|---|
| 5,899,357 | A | 5/1999 | Yuyama et al. | |
| 6,053,302 | A * | 4/2000 | Leu | G06M 11/00 198/803.5 |
| 6,349,848 | B1 | 2/2002 | Uema et al. | |
| 2002/0096535 | A1 | 7/2002 | Zhang et al. | |
| 2004/0182878 | A1 | 9/2004 | Ho | |
| 2012/0311973 | A1 | 12/2012 | Cremer | |
| 2013/0103188 | A1* | 4/2013 | Yuyama | G07F 11/62 221/124 |
| 2013/0233894 | A1 | 9/2013 | Kim | |
| 2014/0138398 | A1* | 5/2014 | Daniels | B65D 83/04 221/202 |
| 2014/0318078 | A1 | 10/2014 | Kondo et al. | |
| 2019/0112080 | A1* | 4/2019 | Holmes | B65B 57/14 |

FOREIGN PATENT DOCUMENTS

| | | | |
|---|---|---|---|
| KR | 20180106094 | A | 10/2018 |
| WO | 2019195629 | A1 | 10/2019 |

OTHER PUBLICATIONS

European Patent Office. Partial Supplementary European Search Report for Application No. 21757310.4, dated Mar. 21, 2024 (15 pages).

European Patent Office. Extended European Search Report for Application No. 21757310.4, dated Jun. 11, 2024 (12 pages).

* cited by examiner

AUTOMATIC PACKAGER FOR MEDICAL PRODUCTS

CROSS-REFERENCE TO RELATED APPLICATIONS

This application claims priority to U.S. Provisional Patent Application No. 62/978,174, filed Feb. 18, 2020, the entire contents of which are incorporated by reference herein.

FIELD OF THE INVENTION

The present invention relates to an automatic packager for supplements.

SUMMARY

One embodiment provides a cartridge for an automatic packager including a reservoir for storing a plurality of medical products and a wheel including a bottom portion placed in the reservoir. The wheel being rotatable with respect to the reservoir. The cartridge also includes a scooping member provided on the wheel to rotate with the wheel and singulate a medical product from the reservoir, and a funnel extension coupled to the reservoir and extending outward and upward from the reservoir.

Another embodiment provides an automatic packager for packaging medical products including a universal feed cassette having a housing, a plurality of cartridge slots within the housing, and a plurality of dispensing openings provided on a bottom of the housing corresponding to the plurality of cartridge slots. The automatic packager also includes a packaging unit including chutes in communication with the plurality of dispensing openings. Each of the plurality of cartridge slots are configured to receive a cartridge. The cartridge includes a reservoir for storing a plurality of medical products, and a wheel including a bottom portion placed in the reservoir. The wheel being rotatable with respect to the reservoir. The cartridge also includes a scooping member provided on the wheel to rotate with the wheel and singulate a medical product from the reservoir, and a funnel extension coupled to the reservoir and extending outward and upward from the reservoir.

Another embodiment provides a method of filling medical products in an automatic packager. The automatic packager includes a universal feed cassette having a housing, a plurality of cartridge slots within the housing, and a plurality of dispensing openings provided on a bottom of the housing corresponding to the plurality of cartridge slots, and a packaging unit having chutes in communication with the plurality of dispensing openings. The method includes inserting a cartridge into one of the plurality of cartridge slots, the cartridge including a reservoir for storing a plurality of medical products, a wheel having a bottom portion placed in the reservoir and being rotatable with respect to the reservoir, a scooping member provided on the wheel to rotate with the wheel and singulate a medical product from the reservoir, and a funnel extension coupled to the reservoir and extending outward and upward from the reservoir. The method also includes filling the reservoir of cartridge with medical products by pouring the medical products into the funnel extension without removing the cartridge from the cartridge slot.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Supplements such as dietary supplements (for example, multi-vitamins, minerals, and the like) are generally purchased over the counter at pharmacies and grocery stores. These supplements are purchased in bulk containers and taken according to the instructions on the containers.

Typically consumers are not prescribed supplements. Rather, consumers purchase supplements on their own accord based on personal needs. More recently, consumers are turning to online supplement stores to purchase these supplements. Online stores can provide personal recommendations to consumers based on lifestyle information received from the consumers. Purchasing bulk containers makes it difficult for consumers to adhere to the recommendations. Most consumers store bulk containers at home. Due to various obligations, for example, work, school, and the like, consumers may not be home to take the supplement at the recommended time. Carrying around bulk containers or separating supplements into smaller containers may not be always feasible.

Accordingly, there is a need for high-volume and high-efficiency automatic packaging of supplements into separable packages. These packages allow consumers to take the packages with them wherever they go and results in better adherence to recommendations. Systems and method described below are directed to automatic packagers that package supplements into strip packages or blister cards.

Figure 1:
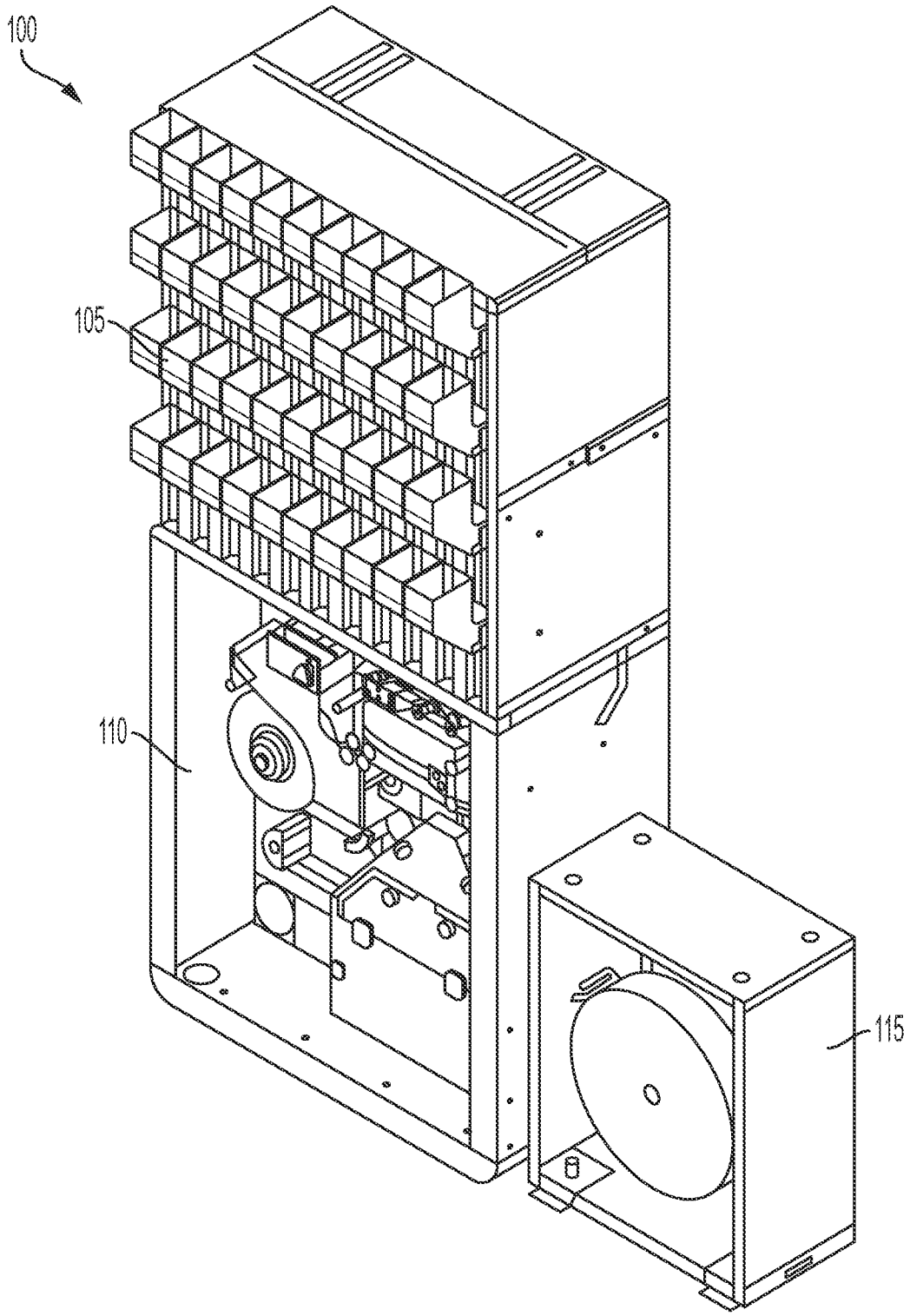
FIG. 1 is a perspective view of an automatic packager in accordance with some embodiments.

FIG. 1 illustrates an example of an automatic packager 100 that efficiently packages supplements or medications in a quick and accurate manner. The term medical products below is used to refer to both supplements that are provided without a prescription or medications provided with a prescription. In the example illustrated, the automatic packager 100 includes a universal feed cassette 105, a packaging unit 110, and a spooling unit 115. The universal feed cassette 105 receives supplements from bulk canisters and individually dispenses supplements to the packaging unit 110. Supplements may be in any form, for example, a pill, a capsule, a gummy, and the like. Each universal feed cassette 105 may dispense forty separate supplements at the same time.

Figure 2:
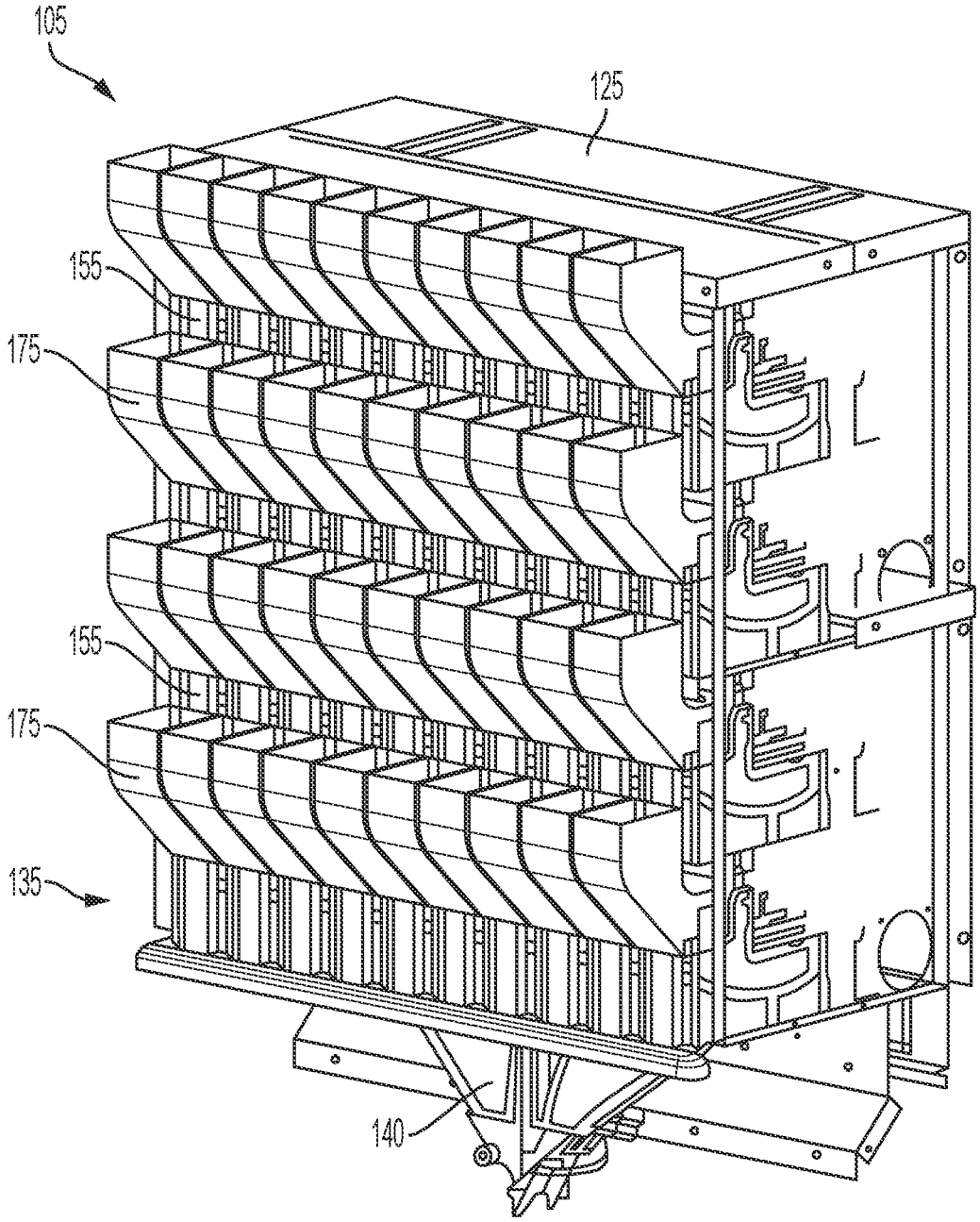
FIG. 2 is a front perspective view of a universal feed cassette of the automatic packager of FIG. 1 in accordance with some embodiments.
Figure 3:
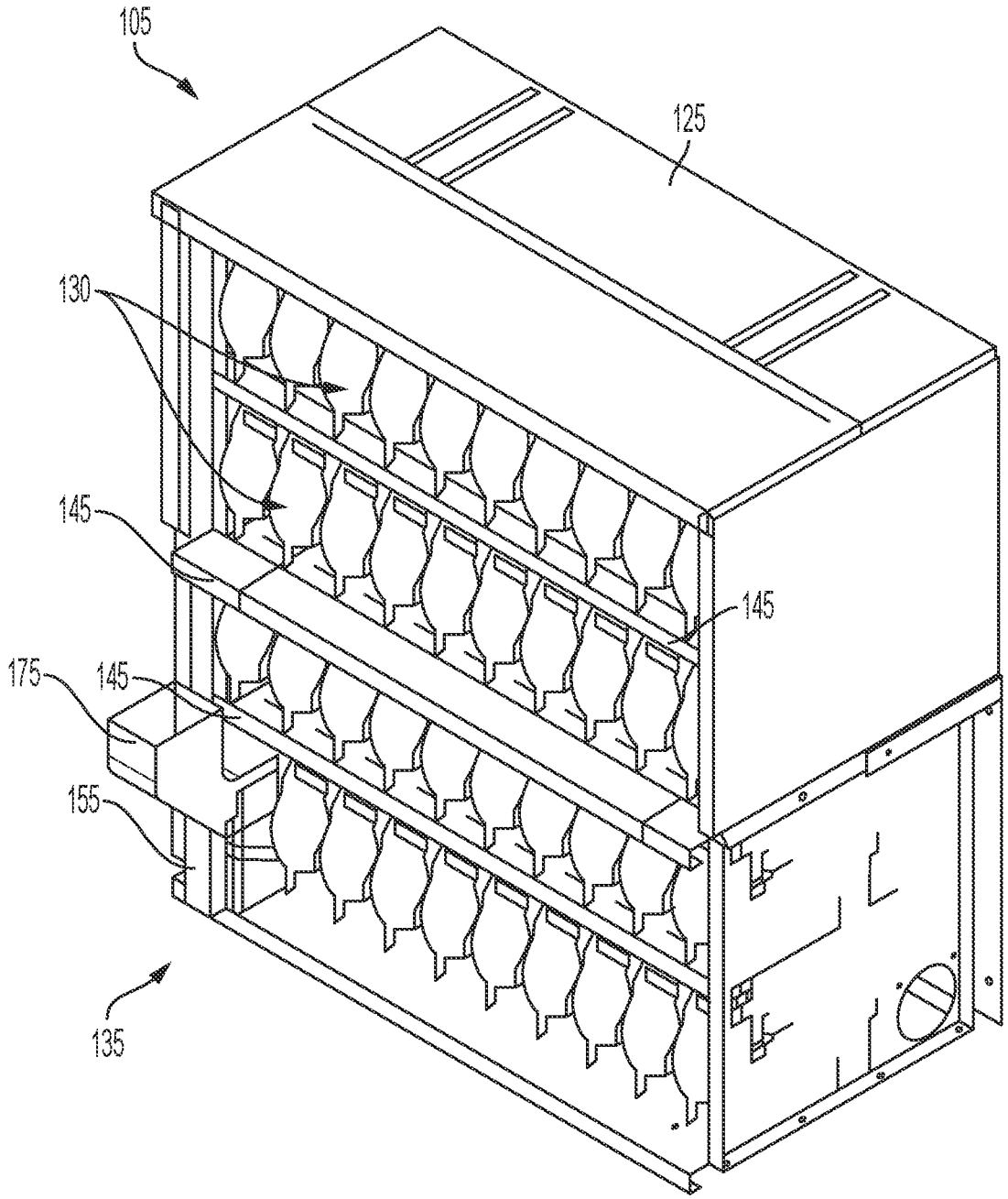
FIG. 3 is a front perspective view of the universal feed cassette of FIG. 2 with a part of a housing removed in accordance with some embodiments.
Figure 4:
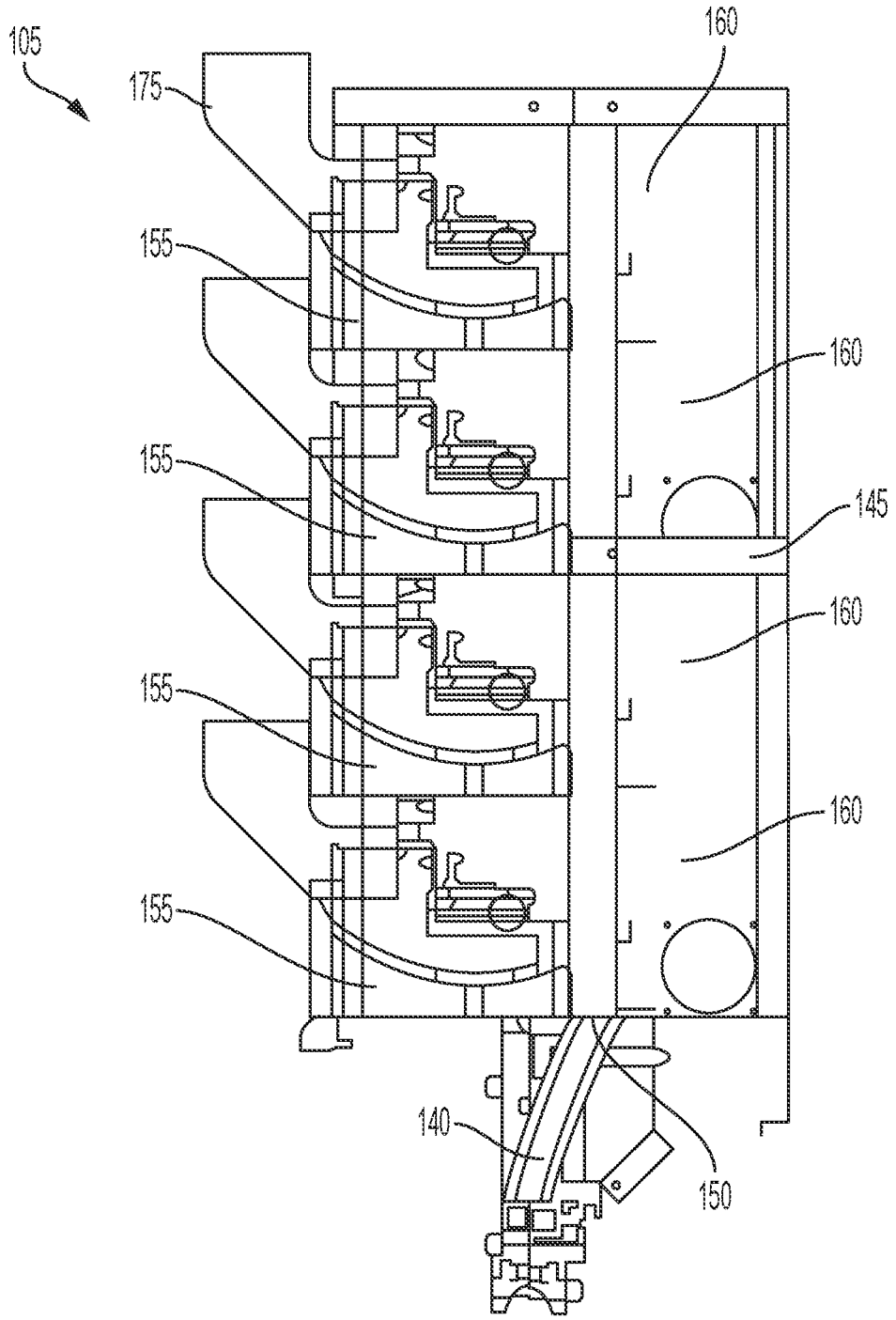
FIG. 4 is a plan view of a portion of the universal feed cassette of FIG. 2 in accordance with some embodiments.

Referring to FIGS. 2-4, the universal feed cassette 105 includes a housing 125 having a plurality of cartridge slots 130 within the housing 125. An opening 135 is provided on a front side (e.g., a first side) of the housing 125 and a cassette cover covers a back side (e.g., a second side) of the housing 125. A plurality of dispensing openings 150 are provided on the bottom of the housing 125 corresponding to the plurality of cartridge slots 130. The dispensing openings 150 are in communication with a chute 140 of the packaging unit 110.

In the example illustrated in FIGS. 2-4, the universal feed cassette 105 includes up to forty cartridge slots 130. The cartridge slots 130 are arranged in a four-level formation such that a second row of cartridge slots 130 are provided above a first row of cartridge slots 130, a third row of cartridge slots 130 are provided above the second row of cartridge slots 130, and a fourth row of cartridge slots 130 are provided above the third row of cartridge slots 130 within the housing 125 to facilitate faster filling of supplements. In other embodiments, the universal feed cassette 105 may include fewer or more cartridge slots 130. For example, the universal feed cassette 105 may include one, two, three, five, or more rows of cartridge slots 130, and/or each row may include fewer or more than ten cartridge slots 130.

FIG. 4 illustrates a side-profile view of the four-level formation of the cartridge slots 130. A separating platform 145 is provided between the first row and the second row of cartridge slots 130, between the second row and the third row of cartridge slots 130 and between the third row and fourth row of cartridge slots 130. The cartridge slots 130 receive cartridges 155 through the opening 135. A plurality of cartridge mechanisms 160, one for each cartridge slot 130, is fixed to the top of the housing 125—for the fourth row of cartridge slots 130—and the separating platforms 145—for the first row, second row, and third row of cartridge slots 130. When received in the cartridge slots 130, the cartridges 155 are connected to the cartridge mechanism 160. The cartridge mechanism 160 individually dispenses supplements from the cartridge 155 as described in detail below. The dispensing openings 150 transfer the supplements from the cartridges 155 to the packaging unit 110 for packaging. A cassette cover at the back of the universal feed cassette 105 can be removed to access the cartridge mechanisms 160 from the back side of the housing 125. The cartridge mechanisms 160 are removably fixed to the housing 125 such that a technician can remove a cartridge mechanism 160 for servicing.

Referring to FIGS. 5A-8, the cartridge 155 includes a reservoir 170, a funnel extension 175, a wheel 180, and scooping members 185. The reservoir 170 stores the supplements during the dispensing process. The wheel 180 is provided on one side of the cartridge 155 and extends into the bottom portion of the reservoir 170. The bottom portion of the reservoir 170 has a curved shape starting from the side opposite that of the wheel 180, the front side, and the back side and ending at the center of the bottom portion of the wheel 180 (see FIG. 8). The curved shape of the reservoir 170 directs the supplements within the reservoir 170 towards the bottom of the wheel 180 and particularly into the scooping members 185 of the wheel 180.

Figure 5A:
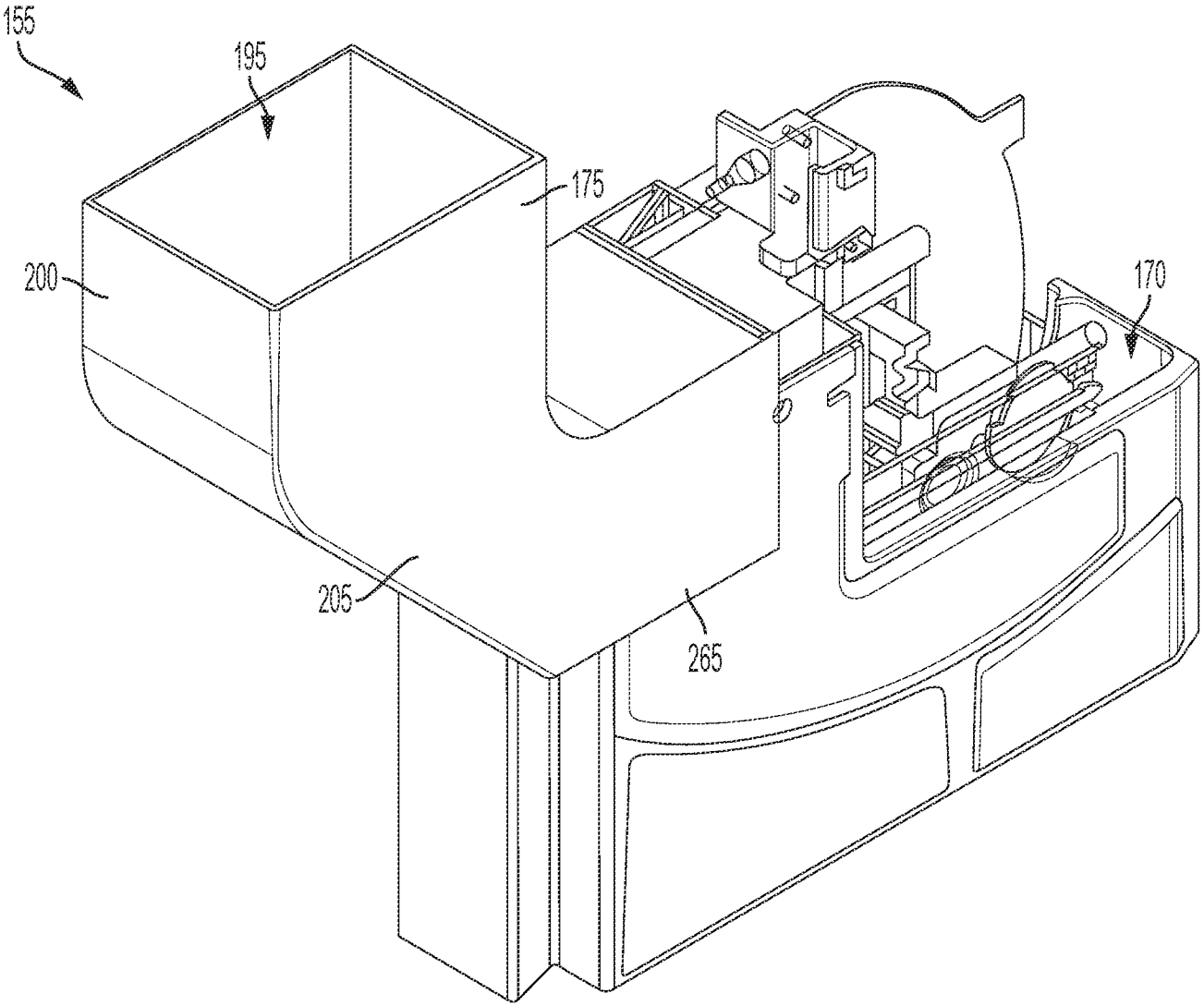
FIG. 5A is a perspective view of a cartridge of the universal feed cassette of FIG. 2 in accordance with some embodiments.
Figure 5B:
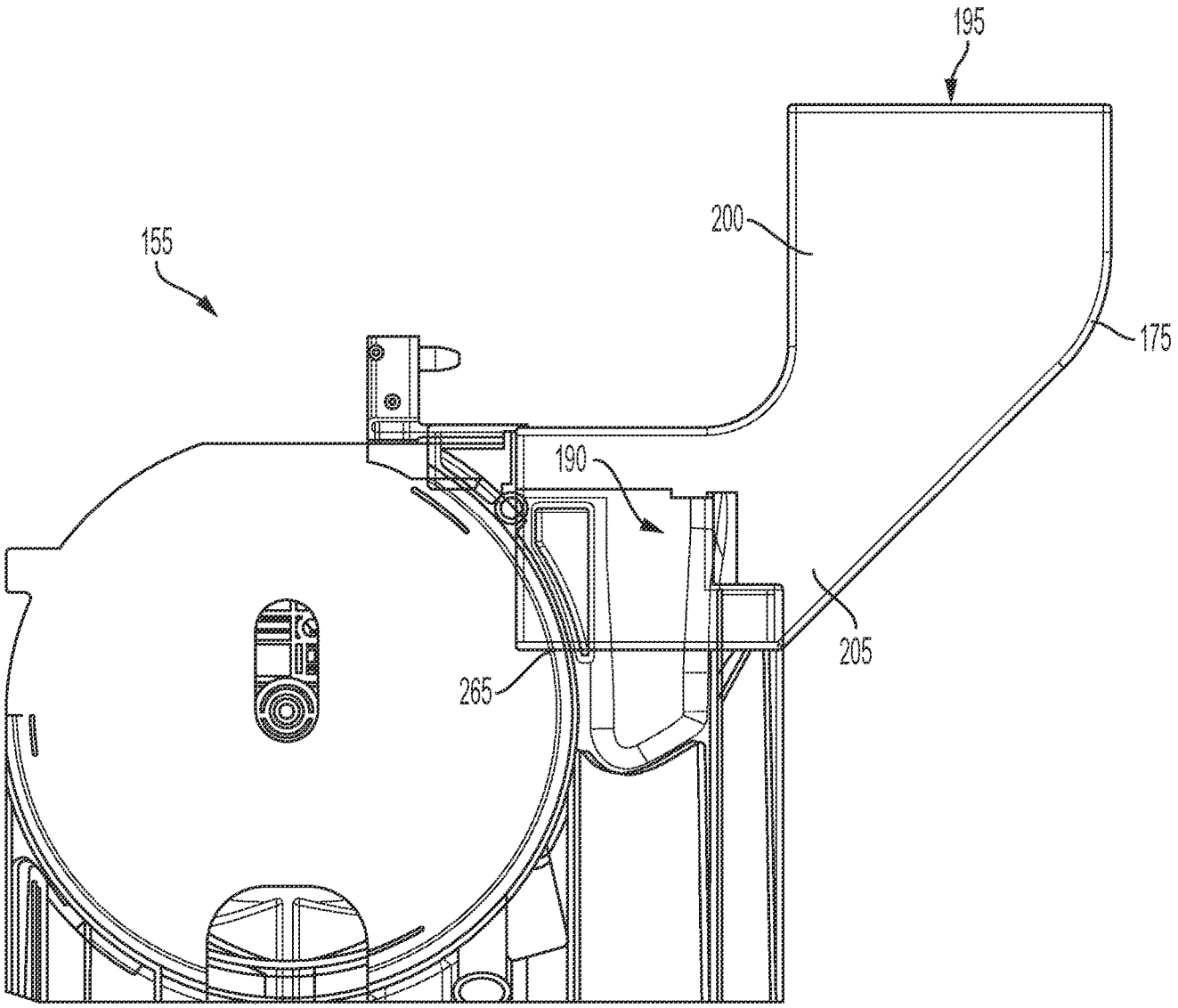
FIGS. 5B and 5C are plan views of the cartridge of FIG. 5A in accordance with some embodiments.
Figure 5C:
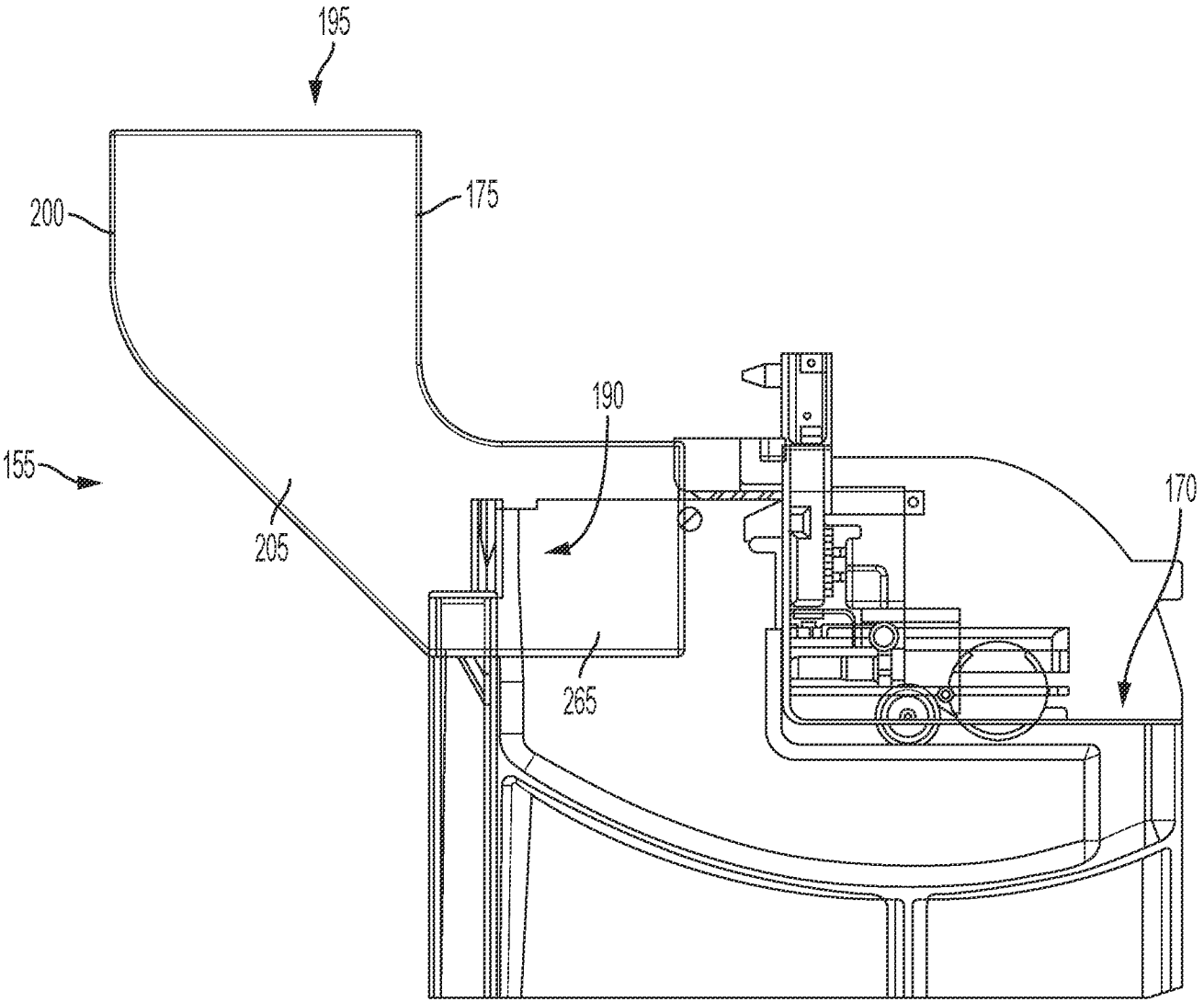

Referring to FIGS. 5A through 5C, the funnel extension 175 extends outward and upward from the reservoir 170 (e.g., from a spout portion 190 of the reservoir 170). The funnel extension 175 includes an opening 195 at the top of the funnel extension 175, a first portion 200 that extends downward from the opening 195 and a second portion 205 that curves and/or extends diagonally from the first portion 200 to the reservoir 170 (or the spout portion 190). A user may therefore replenish the supplements in the cartridge 155 by pouring supplements into the funnel extension 175. More specifically, the user may refill the cartridge 155 without having to remove the cartridge 155 from the corresponding cartridge slot 130. The supplements flow through the opening 195, the first portion 200, the second portion 205, the spout portion 190 into the bottom portion of the reservoir 170. The funnel extension 175 may be made of clear material (e.g., plastic, glass, etc.) such that a user can visibly observe the level of supplements in the cartridge 155 and replenish accordingly. In some embodiments, only a portion of the funnel extension 175 (e.g., a window) may be formed of a clear or transparent material.

Figure 6:
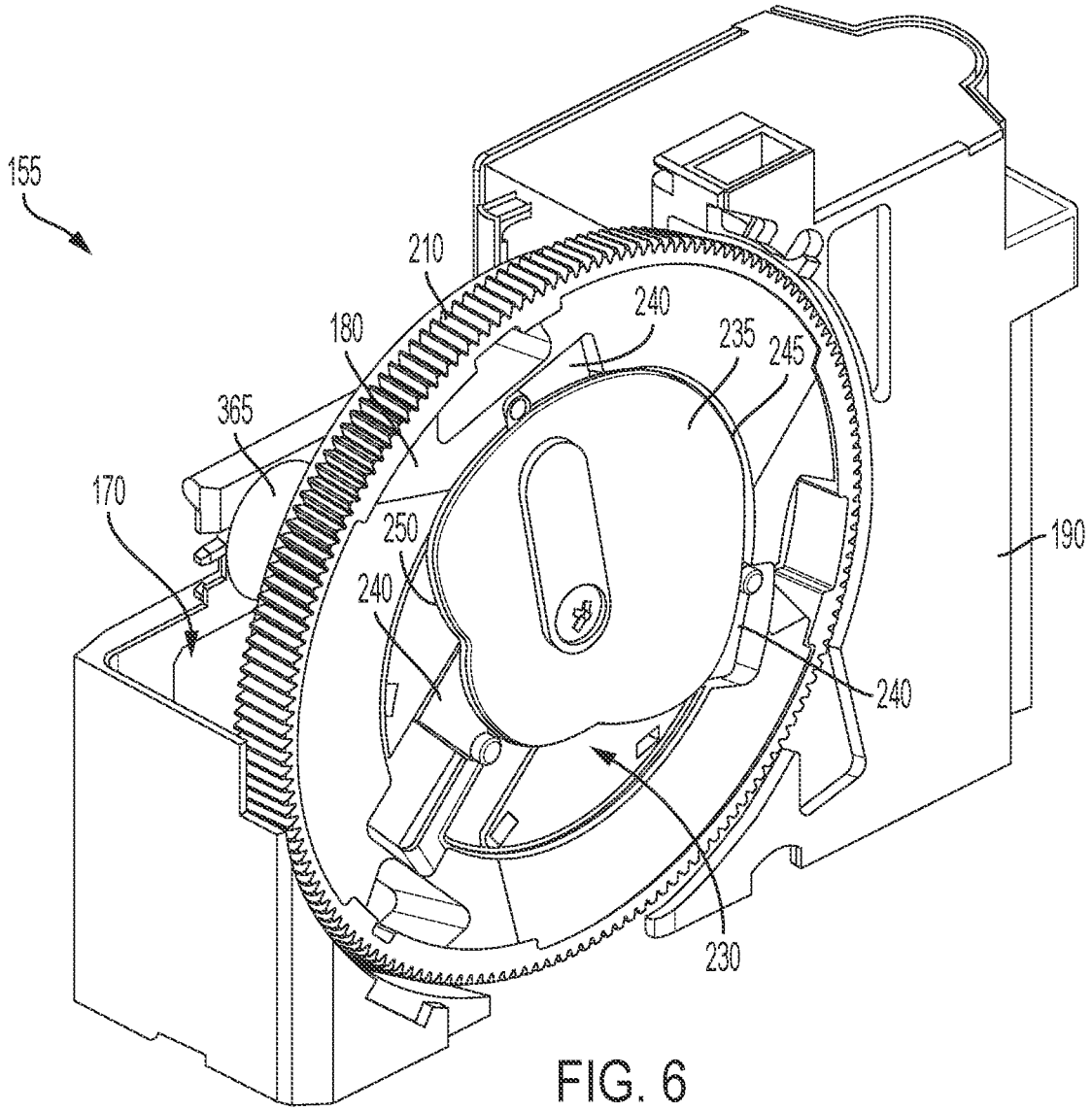
FIG. 6 is a back perspective view of the cartridge of FIG. 5A with a funnel extension removed in accordance with some embodiments.
Figure 7:
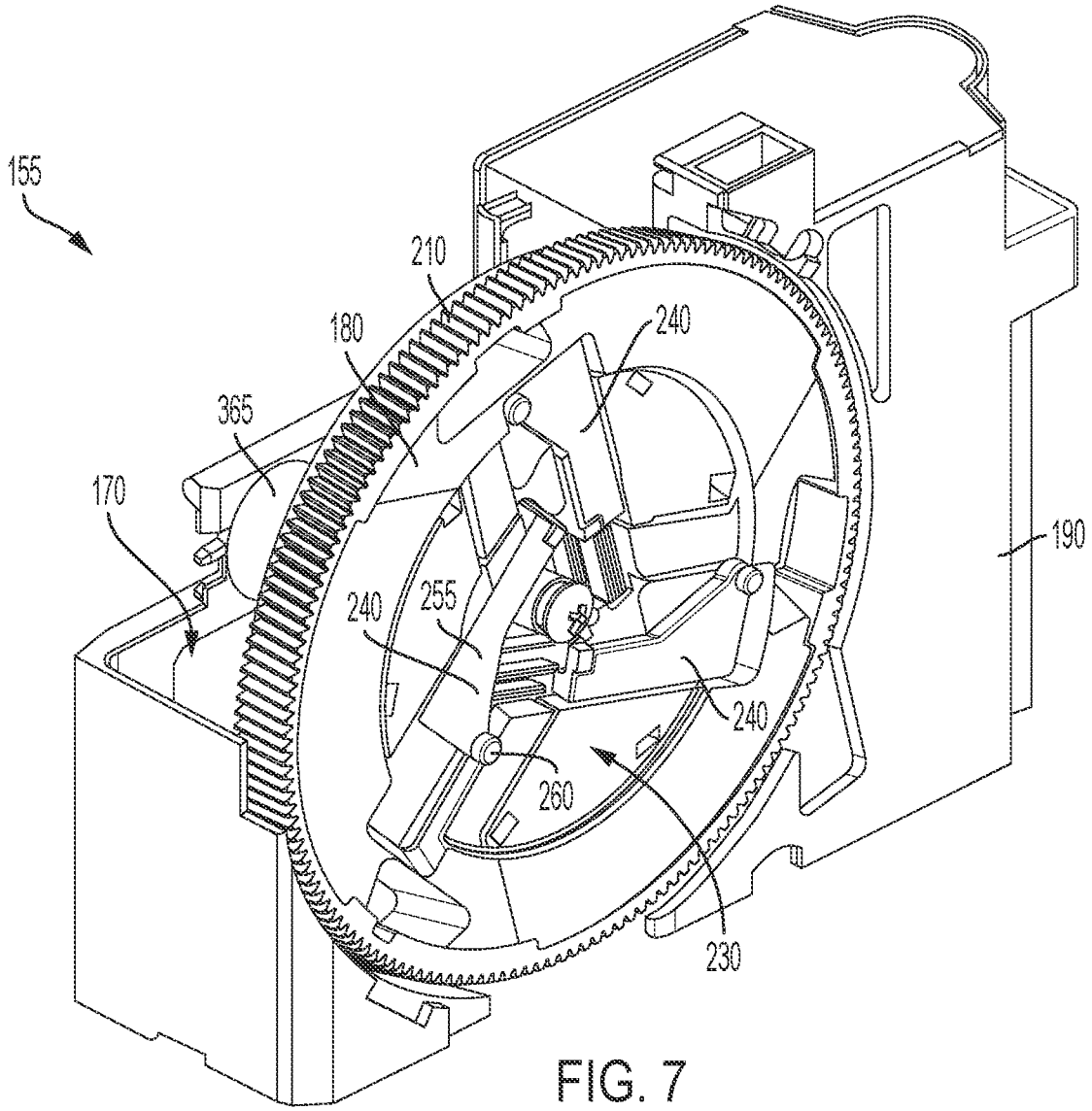
FIG. 7 is a back perspective view of the cartridge of FIG. 5A with a funnel extension removed in accordance with some embodiments.
Figure 8:
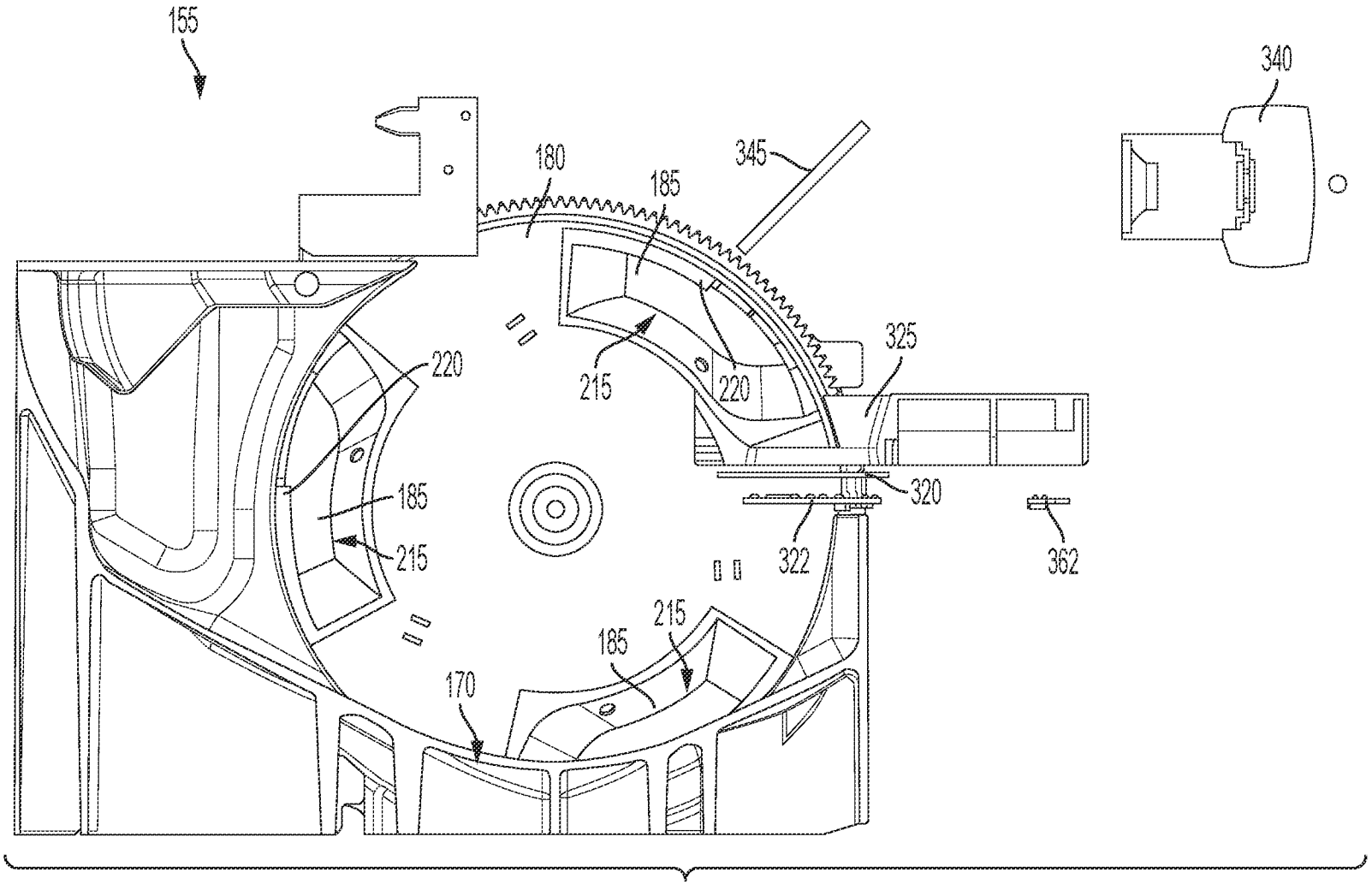
FIG. 8 is a cross-sectional view of the cartridge of FIG. 5A with a funnel extension removed in accordance with some embodiments.

Referring to FIGS. 6 and 7, teeth 210 are provided on the outer circumferential surface of the wheel 180. During the dispensing process, the teeth 210 interlock with teeth of a shaft driven by a motor assembly of the cartridge mechanism 160. Referring to FIG. 8, the wheel 180 is provided with three scooping members 185 to scoop individual supplements from the reservoir 170. The scooping members 185 include an inward projection 215 extending into the wheel 180. The curved surface of the reservoir 170 guides the supplements into the inward projections 215 of the scooping members 185. The scooping members 185 include a stopper 220 along a circumferential end of the inward projections 215 that hold the supplements when the wheel 180 is being rotated. Scooping members 185 may be made in different sizes to accommodate the different sizes of supplements. The scooping members 185 can be swapped to configure the cartridges 155 to dispense supplements of different sizes. The scooping members 185 may also be removed for cleaning. In some embodiments, rather than being separate from the wheel 180, the scooping members 185 may be formed integrally with the wheel 180. In these embodiments, the wheels 180 or cartridges 155 may be swapped to dispense supplements of different sizes.

Figure 10:
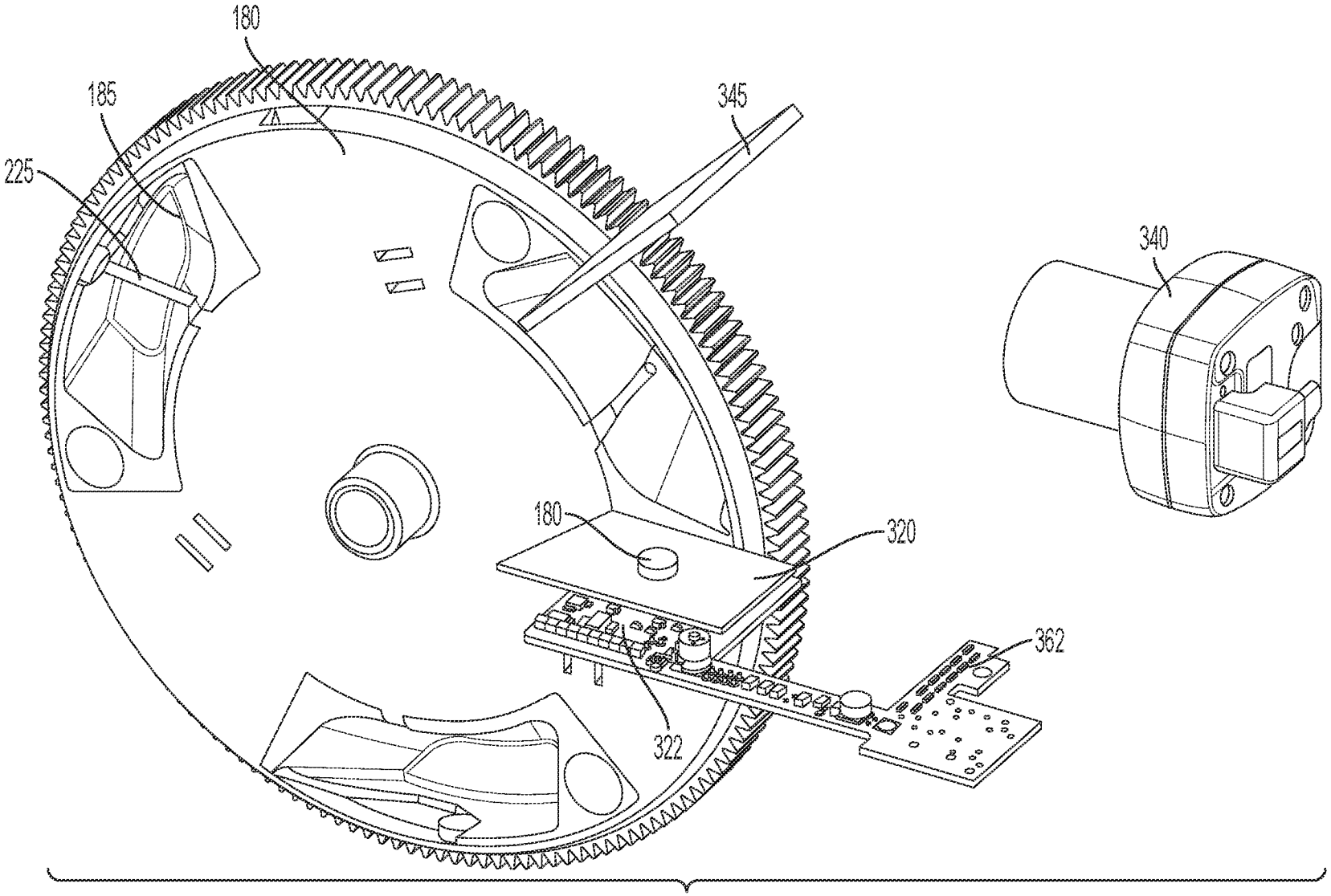
FIG. 10 is a perspective view of the wheel of the cartridge of FIG. 5A and the camera system and the shuttle system of the cartridge mechanism of FIG. 9 in accordance with some embodiments.
Figure 11:
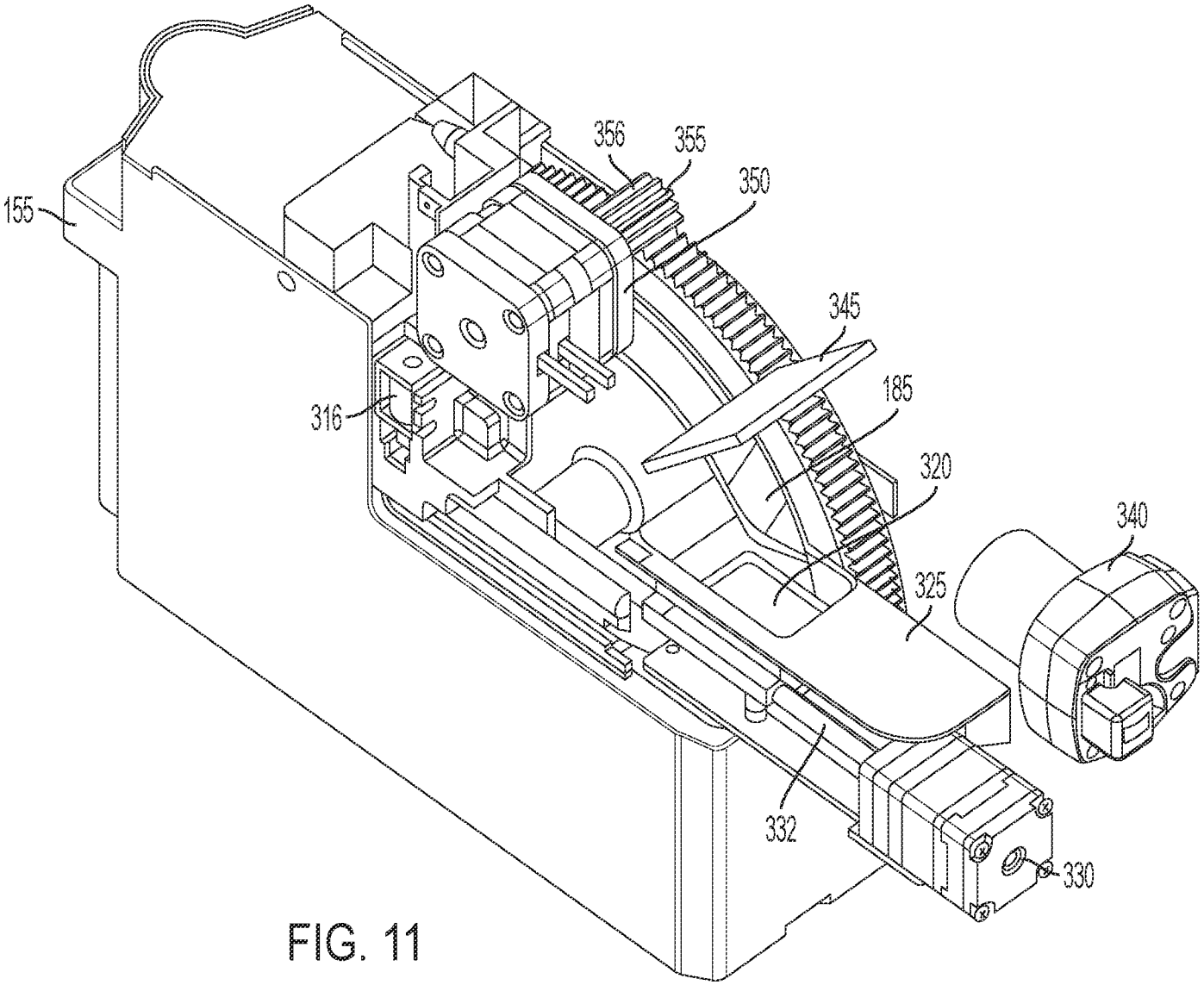
FIG. 11 is a perspective view of the cartridge of FIG. 5A with a funnel extension removed and the cartridge mechanism of FIG. 9 in accordance with some embodiments.
Figure 12:
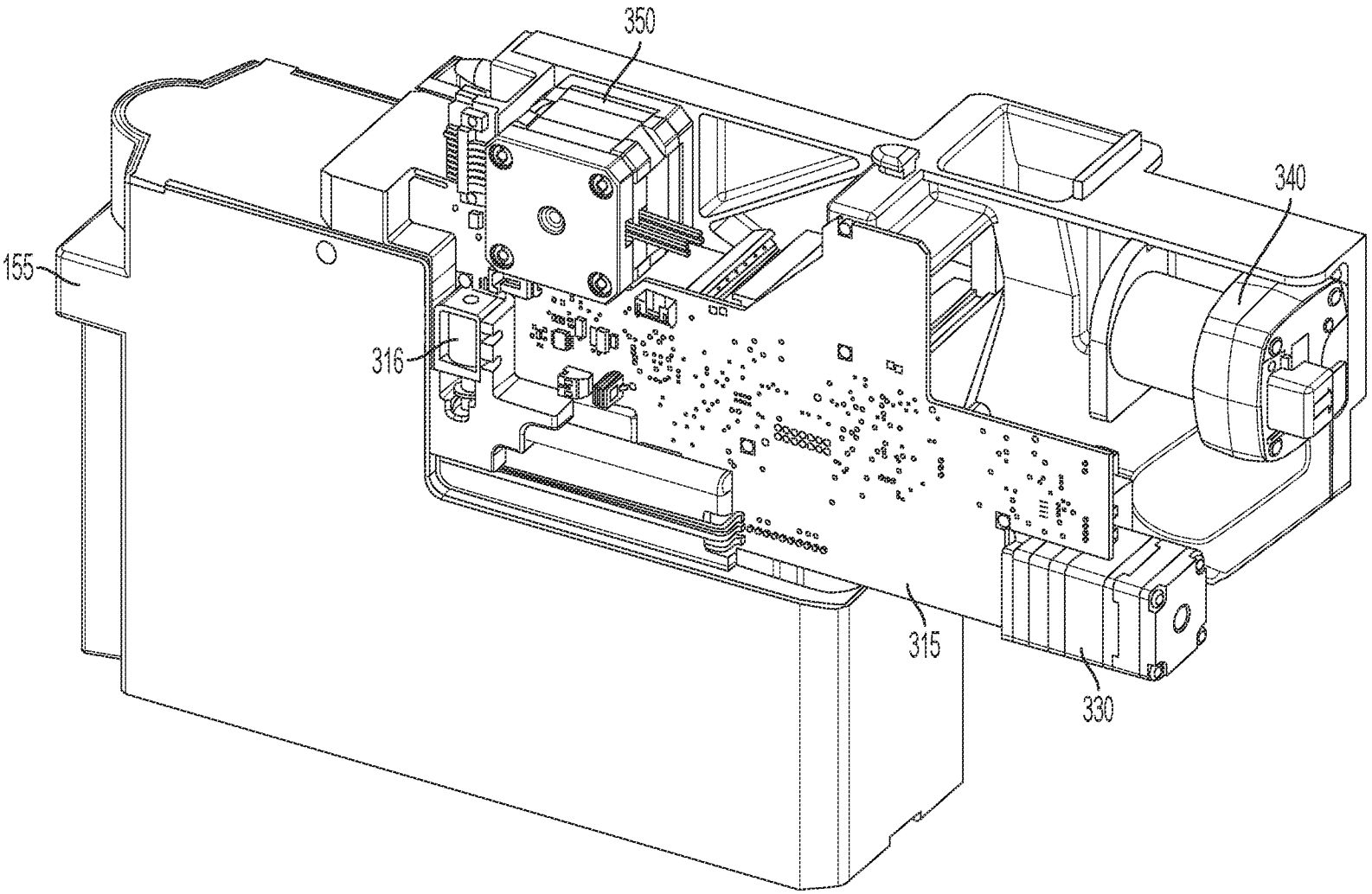
FIG. 12 is a perspective view of the cartridge of FIG. 5A with a funnel extension removed and the cartridge mechanism of FIG. 9 in accordance with some embodiments.

The wheel 180 includes holding pins 225 (see FIG. 10) that extend and retract from the inside of the wheel 180 during rotation of the wheel 180. The scooping members 185 include an opening to receive the holding pins 225. The holding pins 225 along with the stopper 220 and the circumferential surface of the inward projection 215 are used to hold a supplement when the wheel 180 is being rotated. During rotation of the wheel 180, when the inward projections 215 of the scooping members 185 encounter the reservoir 170, the supplements in the reservoir 170 move inward into the scooping members 185 due to the curved shape of the reservoir 170. The holding pins 225 are retracted when the scooping members 185 are moving along the reservoir 170 at a bottom portion of the wheel 180. As the scooping members 185 move out of the reservoir 170, the holding pins 225 are advanced towards the circumferential end of the scooping members 185 to engage a supplement. The supplements are held between the circumferential end of the scooping member 185, the holding pin 225, and the stopper 220. The scooping member 185 and the holding pin 225 can be used for any type or size of supplement. Typically, only a single supplement is pinched between the holding pin 225 and the scooping member 185, while the other supplements fall back into the reservoir 170 during the rotation of the wheel 180. As the scooping member 185 passes the top portion of the wheel 180, the holding pin 225 is once again retracted to release the supplements into the cartridge mechanism 160. The wheel 180 and the scooping member 185 may together be referred to as a singulating mechanism.

FIGS. 6 and 7 illustrate a cam and follower mechanism 230 that is used to advance and retract the holding pins 225. The cam and follower mechanism 230 is provided in the wheel 180. The cam and follower mechanism 230 includes a cam 235 and a plurality of followers 240. In the example illustrated, the cartridge 155 includes three followers 240, one for each of the holding pins 225. The holding pins 225 are attached to the followers 240 to move with the followers 240. The cam 235 is fixed to the cartridge 155 and remains stationary even when the wheel 180 is rotated. The cam 235 includes an arc portion 245 and a cut-off portion 250. The arc portion 245 extends further from the center of the cam 235 than the cut-off portion 250. The follower 240 includes a flat portion 255 that is coupled to a holding pin 225 and an outward projection 260 extending from the flat portion 255 to engage the circumferential surface of the cam 235. A spring mechanism is connected to a radially inward end of the followers 240 to provide an inward biasing force to the followers 240. The holding pin 225 is advanced when the corresponding follower 240 engages the arc portion 245 of the cam 235 and is retracted when the corresponding follower 240 engages the cut-off portion 250 of the cam 235. The follower 240 is retracted due to the biasing force of the spring mechanism when the follower 240 engages the cut-off portion 250 of the cam 235.

Referring to FIGS. 9-12, the cartridge mechanism 160 includes a shuttle system 300 (for example, a verification system), a camera system 305, a motor assembly 310, a printed circuit board 315, and a lockout mechanism 316. The shuttle system 300, shown in FIG. 11, includes a platform 320, a shuttle 325, and a shuttle drive 330. The platform 320 may be made from a clear or translucent plastic material. An LED lighting system 322, as described above, may be provided over and/or under the platform 320 to illuminate the contents on the platform 320 when the camera system 305 is capturing an image of the contents. The LED lighting system 322 may emit visible or infrared light to illuminate the platform 320.

Typically, a single LED device may be used below the platform 320 to illuminate the translucent platform 320. However, the single LED device may not provide uniform lighting through all of the surface area of the platform 320. Particularly, each LED device includes a light signature such that the center of the platform 320 is brighter than the edges of the platform. This irregularity in brightness may result in misidentifying supplements during the image recognition process. In order to provide uniform brightness across the surface are of the platform, several LED devices may be placed around the bottom surface of the platform. In some embodiments, the light signature of the LED device is detected and a backing (not shown) may be applied to the platform to correct the light signature of the LED device. The backing, when applied to the platforms 320, distributes the light from the LED device of the LED lighting system 322 such that every portion of the platform 320 is illuminated with similar brightness.

The shuttle 325 may be moved laterally between the platform 320, over the reservoir 170, and over a conduit 335. The shuttle 325 transfers the supplements from the platform 320 either to the reservoir 170 or to the conduit 335. The shuttle 325 is driven by the shuttle drive 330. The shuttle drive 330 may be a motor assembly, an actuator, or the like that moves the shuttle 325 between the platform 320, over the reservoir 170, and over the conduit 335. In the example illustrated, the shuttle drive 330 includes a rotating screw 332 that moves the shuttle 325 laterally between the platform 320, the reservoir 170, and the conduit 335.

Referring to FIGS. 5A through 5C, the funnel extension 175 includes an opening at the end of the second portion 205 that allows the supplements poured into the funnel extension 175 to flow to the reservoir 170. The opening in the second portion 205 is provided below the shuttle 325 and the platform 320. By providing the opening in the second portion 205 below the shuttle 325 and the platform 320, overcrowding of the platform with the supplements can be avoided. The funnel extension 175 may extend beyond a height of the reservoir 170. Having the opening in the second portion 205 above the shuttle 325 or the platform 320 may result in supplements rushing into the reservoir 170 and onto the platform 320 and the shuttle 325. This will prevent singulation as more than one supplement may be present on the platform 320. To avoid such a situation, the opening in the second portion 205 is provided below the platform 320 and the shuttle 325 such that the reservoir 170 is refilled only to a level below the platform 320 and does not affect the singulation mechanism.

The funnel extension 175 includes a throttle 265 at the opening in the second portion 205. In some embodiments, the throttle 265 includes a supplement opening that is sized to allow a limited number of supplements to pass through at a time. In some embodiments, the throttle 265 is a rotating plate and an actuation mechanism is used to rotate the throttle 265 to transfer the supplements from the funnel extension 175 to the reservoir 170. By limiting the number of supplements passing to the reservoir, the throttle 265 (and thereby the funnel extension 175) prevents overcrowding in the cartridge 155. The throttle 265 may come in different sizes to accommodate different types of supplements. The throttle 265 and/or the funnel extension 175 may be changed for each type of supplement. In some embodiments, the throttle 265 may include different sized supplement openings such that the throttle 265 may be rotated such that only one supplement opening is exposed to allow supplements to pass through. The throttle 265 may be rotated prior to placing the cartridge 155 in the universal feed cassette 105 to select the correct supplement opening corresponding to the supplement being dispensed from the cartridge 155.

In some embodiments, the throttle 265 includes a plate pivotably attached to the opening in the funnel extension 175 using a hinge or other mechanism. The throttle 265 can be pivoted to a fully closed position in which the opening in the funnel extension 175 is fully closed and prevents supplements from going through to the reservoir 170. The throttle 265 can be moved from the fully closed position inward into the funnel extension 175 or outward into the reservoir 170 to provide different size of openings for the supplements to flow through to the reservoir 170.

As seen from the perspective of FIG. 5C, the wheel 180 rotates in a clockwise direction to pick up the supplements from the reservoir 170. The movement of the wheel 180 toward the throttle 265 as the wheel 180 grabs or "scoops" a supplement causes the supplements to bunch up underneath the throttle 265 providing a natural barrier for preventing excessive supplements from entering the reservoir 170 and crowding out the verification mechanism. In some embodiments, the opening and the throttle 265 may be provided on a side of the funnel extension 175 rather than at the bottom of the funnel extension 175.

Returning to FIGS. 9-12, the camera system 305 includes a camera 340 and a mirror 345. The camera 340 is positioned at the back of the cartridge mechanism 160. The camera 340 may be a still camera or a video camera that captures an image of the contents of the platform. The mirror 345 is placed directly above the platform 320 and is tilted at a 45-degree angle such that the camera 340 positioned at the back of the cartridge mechanism 160 can capture an image of the platform 320.

The motor assembly 310 includes a motor 350 that drives a shaft 355 positioned in the middle of the cartridge mechanism 160. The shaft 355 includes teeth 356 that interlock with the teeth 210 of the wheel 180 (see FIG. 11). When the motor 350 is driven, the shaft 355 rotates the wheel 180 to the individually dispense the supplements.

The PCB 315 includes the electrical components of the cartridge mechanism 160. The PCB 315 is positioned on the side opposite that of the wheel 180. In some embodiments, the PCB 315 includes an antenna 360 (see FIG. 9) that detects an RFID tag 365 (see FIGS. 6-7) placed on the cartridge 155. The RFID tag 365 may store information of the cartridge 155. The information stored on the RFID tag 365 may include, for example, identification information of the cartridge 155, supplement restrictions (e.g., dedicated to allergenic supplements (e.g., including fish, eggs, or the like) or non-allergenic supplements) of the cartridge 155, and the like.

The lockout mechanism 316 is, for example, a lockout solenoid that prevents a cartridge 155 from being loaded onto the cartridge mechanism 160 when the lockout mechanism 316 is activated. During a dispensing process, not all cartridge mechanisms 160 may be used to fill a package. In these situations, the lockout mechanism 316 is used to prevent cartridges 155 from being placed on inactive cartridge mechanism 160. In addition, the lockout mechanism 316 may be used to prevent an incompatible or wrong cartridge 155 from being loaded to the cartridge mechanism 160. For example, the cartridge mechanism 160 may read the RFID tag 365 to determine whether the correct and compatible cartridge 155 is being loaded to the cartridge mechanism 160. The cartridge mechanism 160 may only deactivate the lockout mechanism 316 when the correct cartridge 155 is being loaded to the cartridge mechanism 160. The lockout mechanism 316 may also be used to prevent the cartridge 155 from being removed from the cartridge mechanism 160. Particularly, the lockout mechanism 316 locks the cartridge 155 in place when loaded on to the cartridge mechanism 160. During the dispensing process, the lockout mechanism 316 is activated to prevent removal of the cartridge 155. The lockout mechanism 316 may be deactivated when the dispensing process is complete and the cartridge 155 can be removed from the cartridge mechanism 160.

Figure 13:
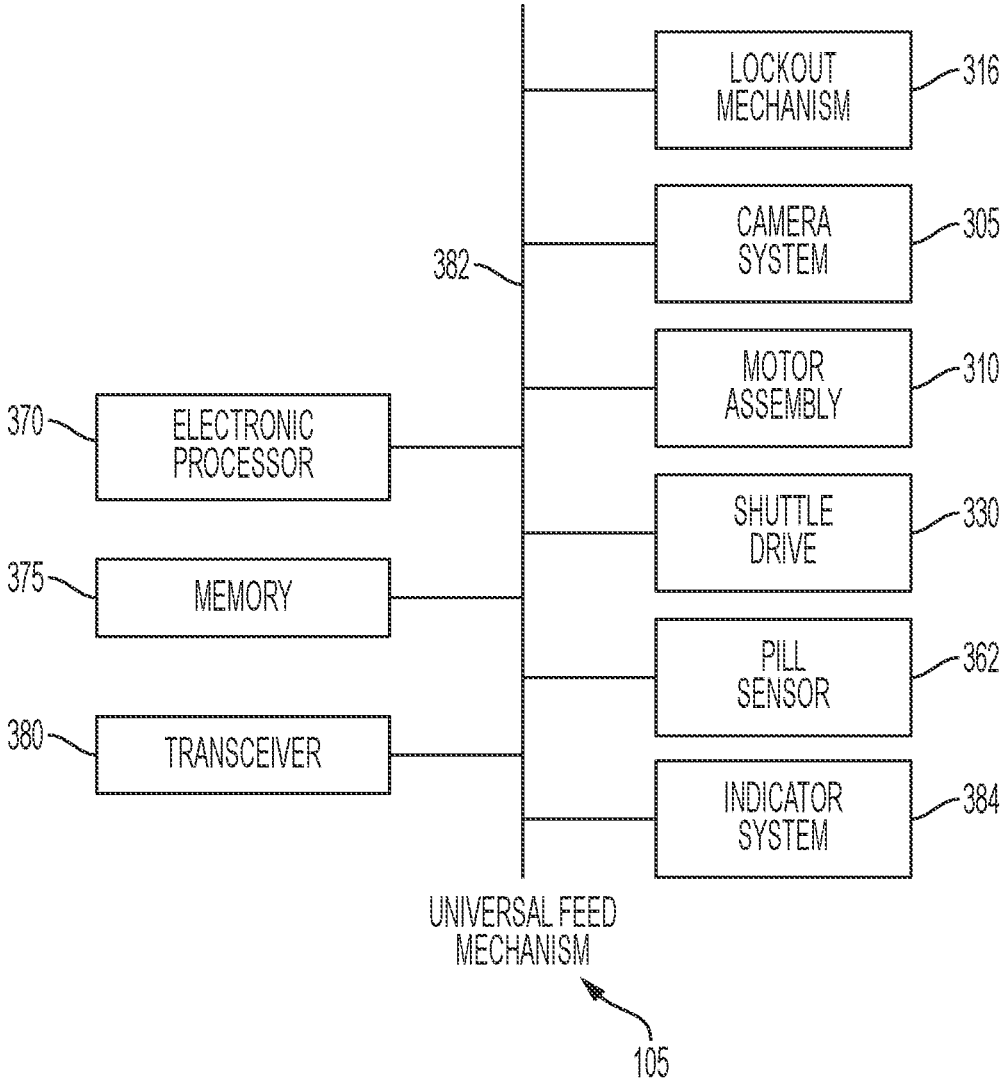
FIG. 13 is a block diagram of the cartridge mechanism of FIG. 9 in accordance with some embodiments.

FIG. 13 is a block diagram of one embodiment of the universal feed cassette 105. In the example illustrated, the universal feed cassette 105 includes an electronic processor 370, a memory 375, a transceiver 380, the camera systems 305, the motor assemblies 310, the lockout mechanisms 316, the shuttle drives 330, the antennas 360, the pill sensors 362, and indicator systems 384. The electronic processor 370, the memory 375, the transceiver 380, the camera system 305, the motor assembly 310, the lockout mechanism 316, the shuttle drive 330, and the pill sensor 362 communicate over one or more control and/or data buses (for example, a communication bus 382). FIG. 13 illustrates only one example embodiment of the cartridge mechanism 160. The cartridge mechanism 160 may include more or fewer components and may perform functions other than those explicitly described herein.

In some embodiments, the electronic processor 370 is implemented as a microprocessor with separate memory, such as the memory 375. In other embodiments, the electronic processor 370 may be implemented as a microcontroller (with memory 375 on the same chip). In other embodiments, the electronic processor 370 may be implemented using multiple processors. In addition, the electronic processor 370 may be implemented partially or entirely as, for example, a field-programmable gate array (FPGA), an applications specific integrated circuit (ASIC), and the like, and the memory 375 may not be needed or be modified accordingly. In the example illustrated, the memory 375 includes non-transitory, computer-readable memory that stores instructions that are received and executed by the electronic processor 370 to carry out the functionality of the cartridge 155 described herein. The memory 375 may include, for example, a program storage area and a data storage area. The program storage area and the data storage area may include combinations of different types of memory, such as read-only memory and random-access memory. FIG.

14 illustrates the universal feed cassette 105 as including a single electronic processor 370 and a single memory 375. However, it should be noted that the universal feed cassette 105 may include separate electronic processor 370 and separate memories with one each for each of the cartridge mechanisms 160. Accordingly, in some embodiments, a single processor performs the functions of the universal feed cassette 105 including all of the cartridge mechanisms 160 of the universal feed cassette 105. In other embodiments, the functions of the universal feed cassette 105 and the cartridge mechanisms 160 may be divided between several processors.

The transceiver 380 enables wired or wireless communication between the electronic processor 370 and a control system of the automatic packager 100 and/or a control system of the packaging unit 110. In some embodiments, the transceiver 380 may include separate transmitting and receiving components, for example, a transmitter and a receiver.

The other components of the universal feed cassette 105 are described singularly with respect to a single cartridge mechanism 160. However, it should be noted that the descriptions and functionality are equally applicable for each cartridge mechanism 160 of the universal feed cassette 105. The camera system 305 receives control signals from the electronic processor 370. Based on the control signals received from the electronic processor 370, the camera system 305 controls the camera 340 and the lighting system that illuminates the platform 320. The motor assembly 310 may send position sensor signals to the electronic processor 370 and receive control signals to operate a motor of the motor assembly 310 based on the position sensor signals. As described above, the shuttle drive 330 may be a motor assembly or an actuator. The shuttle drive 330 may also include a position sensor to determine the position of the shuttle 325. The shuttle drive 330 may send the position sensor signals to the electronic processor 370, which sends control signals to the shuttle drive 330 to move the shuttle 325 based on the position sensor signals. In some embodiments, the shuttle system 300 may also include a shuttle home sensor, which indicates whether the shuttle 325 is at a home position. Signals from the shuttle home sensor are provided to the electronic processor 370 to control the movement of the shuttle 325.

The pill sensor 362 communicates with the electronic processor 370 to provide an indication of whether or not a pill is dispensed through the conduit 335. The electronic processor 370 also controls the indicator system 364 to provide an indication of the status of each cartridge 155. The indicator system 384 may include one or more LEDs provided behind a translucent plastic material. The electronic processor 370 may use the indicator system 384 to provide indications, for example, whether a cartridge 155 is correctly placed in the cartridge slot 130. The electronic processor 370 may activate, for example, a blue LED to indicate that a next cartridge 155 should be placed in the corresponding cartridge slot 130 (that is, the cartridge slot 130 corresponding to the cartridge mechanism 160 with the blue LED activated). The electronic processor 370 may activate, for example, a green LED to indicate that the cartridge 155 was correctly placed in the cartridge slot 130. The electronic processor 370 may activate, for example, a red LED to indicate that the cartridge 155 was not correctly placed in the cartridge slot 130. Additionally, the electronic processor 370 may use the indicator system 384 to provide indications on where to place a cartridge 155 and when to remove a cartridge 155. For example, the electronic processor 370 may activate a blue LED to indicate that a user can place a cartridge 155 in the cartridge slot 130 corresponding to the activated LED. The electronic processor 370 may activate a blue LED again to indicate that the dispensing process is complete and the cartridge 155 can be removed from the cartridge slot 130.

Figure 9:
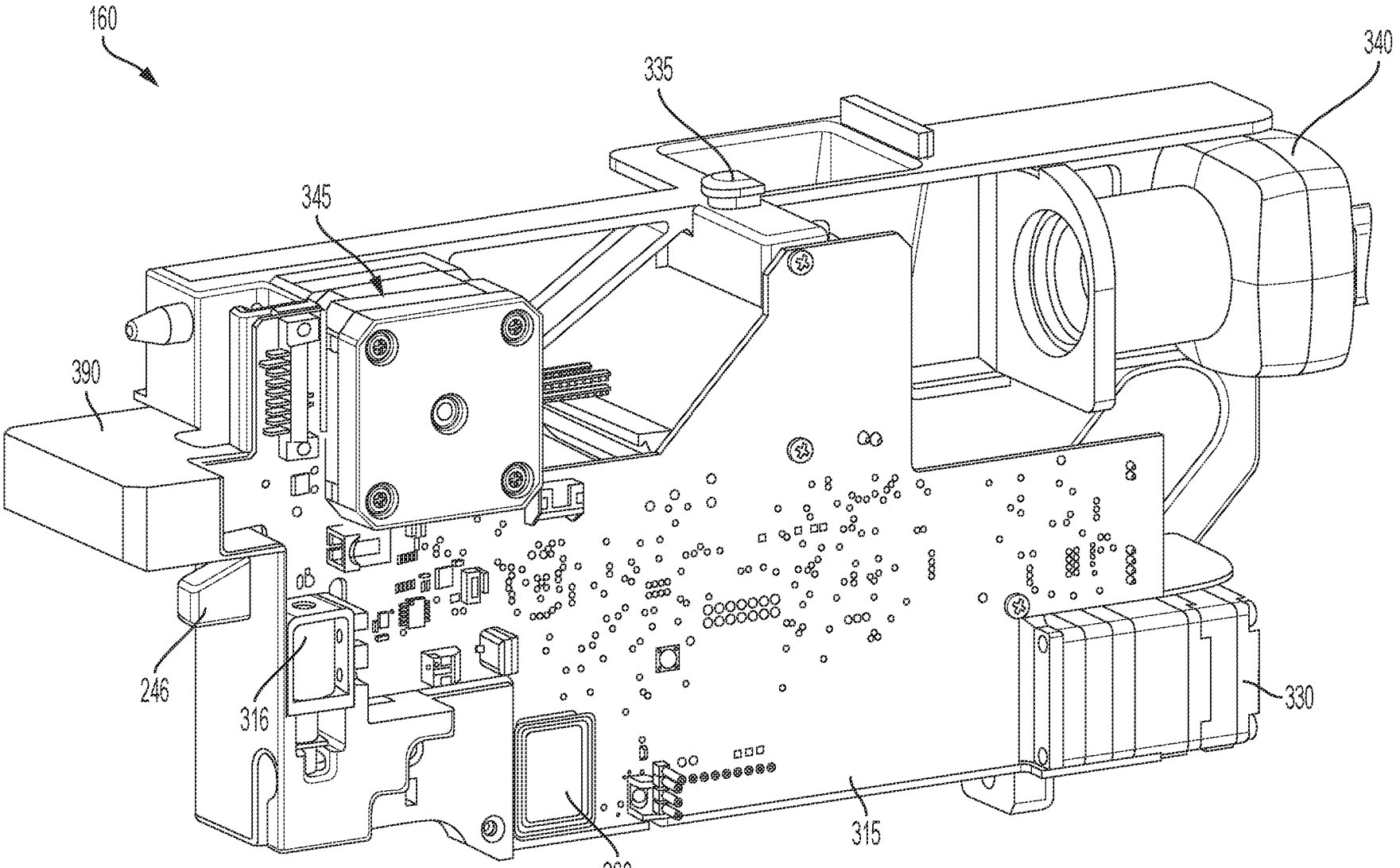
FIG. 9 is a perspective view of a cartridge mechanism of the universal feed cassette of FIG. 2 in accordance with some embodiments.
Figure 14:
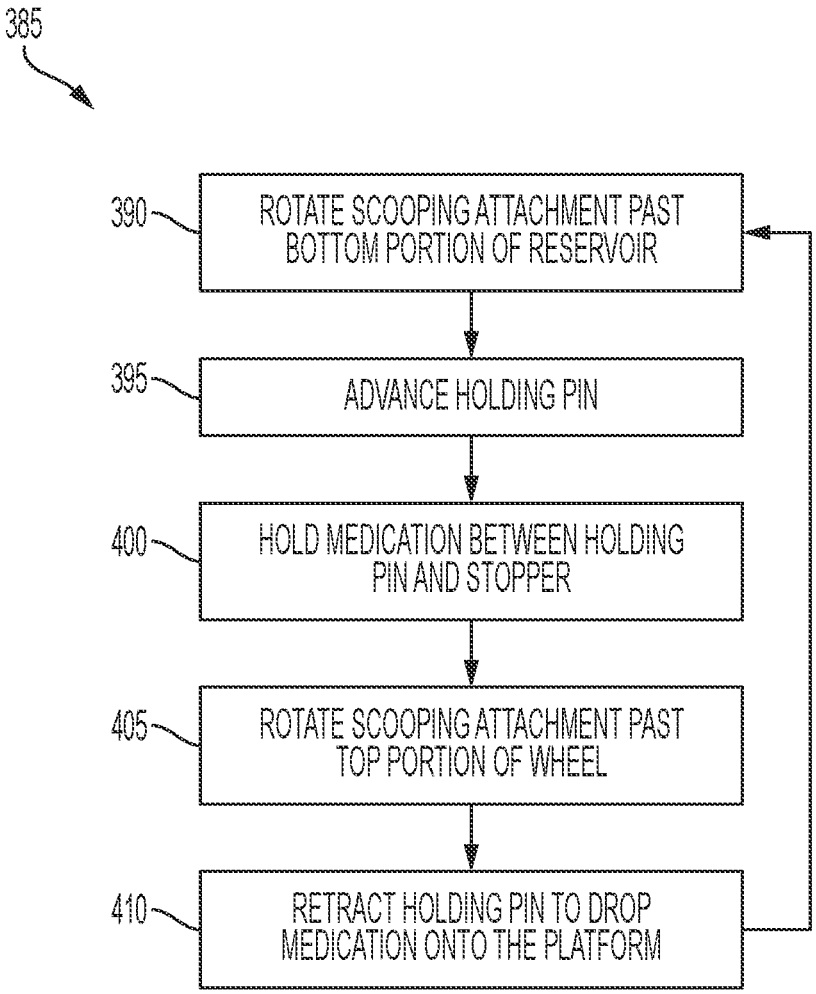
FIG. 14 is a flowchart of a method of delivering supplements to a platform of the cartridge mechanism of FIG. 9 in accordance with some embodiments.
Figure 15:
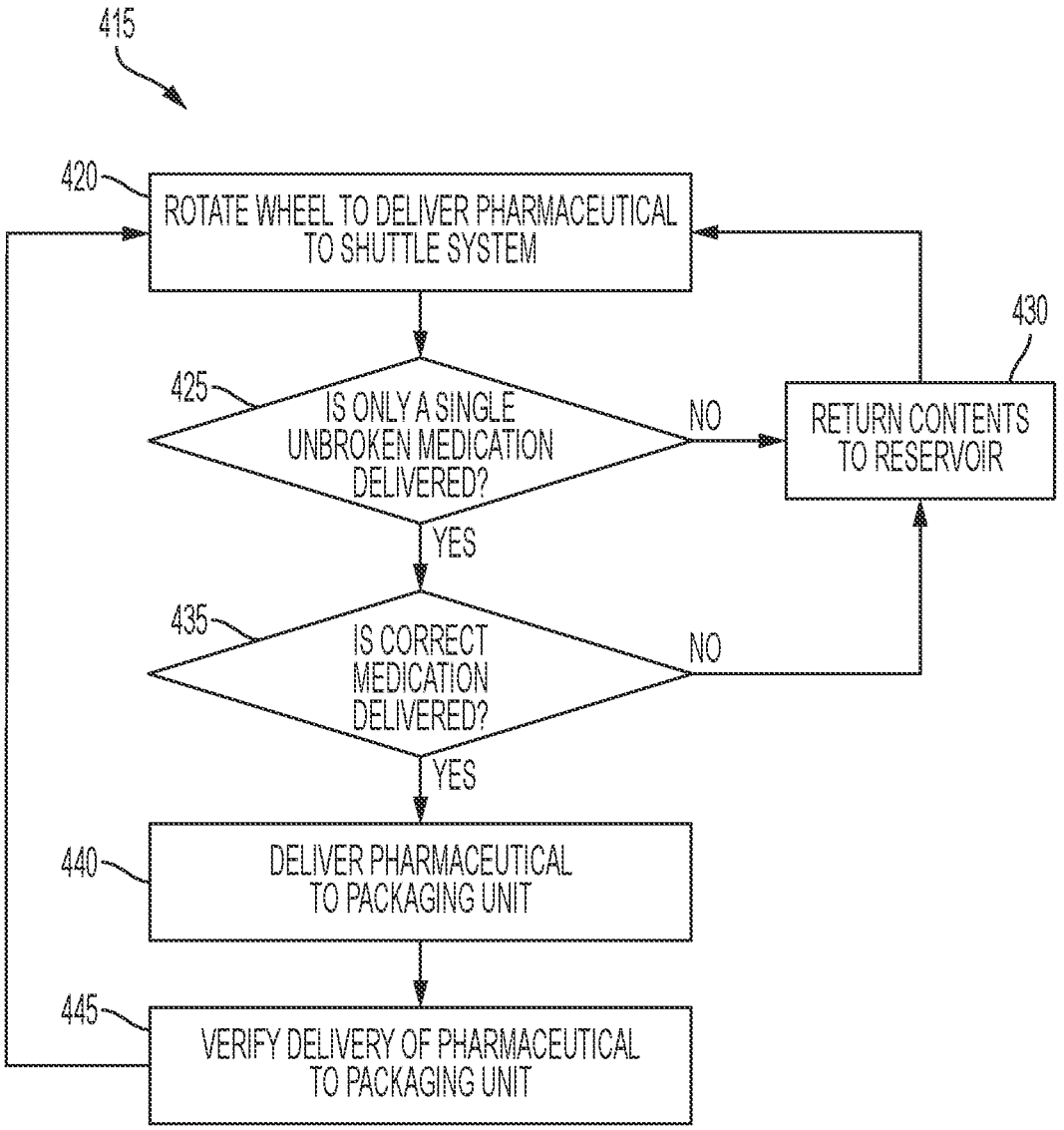
FIG. 15 is a flowchart of a method of dispensing supplements from the cartridge of FIG. 5 in accordance with some embodiments.

FIG. 14 is a flowchart illustrating one example method 385 of delivering supplements to the platform 320. As illustrated in FIG. 15, the method 385 includes rotating, using the motor assembly 310, a scooping member 185 past the bottom portion of the reservoir 170 (at block 390). Referring to FIG. 9, when the scooping member 185 is at the bottom portion of the reservoir 170, the supplements move into the inward projection 215 of the scooping member 185 due to the curved shape of the reservoir 170. As the supplements move into the inward projection 215, the stopper 220 of the scooping member 185 carries at least one supplement past the bottom portion of the reservoir 170 as the scooping member 185 is rotated past the bottom portion of the reservoir 170. The scooping members 185 are placed within the wheel 180 along circumferential ends of the wheel 180. The wheel 180 is rotated to rotate the scooping members 185. As described above, teeth 210 of the wheel 180 interlock with teeth of the shaft 355, which is driven by the motor 350.

The method 385 also includes advancing, using the cam and follower mechanism 230, the holding pin 225 into the scooping member 185 (at block 395). Referring to FIGS. 6 and 8, as the scooping member 185 is rotated past the bottom portion of the reservoir 170, the follower 240 corresponding to the scooping member 185 encounters the arc portion 245 of the cam 235. The follower 240 is then advanced, which advances the holding pin 225 towards a circumference of the inward projection 215 of the scooping member 185.

The method 385 further includes holding the supplement between the holding pin 225 and the stopper 220 (at block 400). When the holding pin 225 is advanced, a supplement is held between the holding pin 225, the circumferential end of the scooping member 185, and the stopper 220. The supplement is held in such a way until the scooping member 185 moves past the top portion of the wheel 180.

The method 385 also includes rotating, using the motor assembly 310, the scooping member 185 past the top portion of the wheel 180 (at block 405). As discussed above, the motor assembly 310 rotates the wheel 180 to rotate the scooping members 185. The motor assembly 310 may also include a position sensor (not shown) to detect a position of the wheel 180. For example, the motor assembly 310 may include a Hall sensor to detect magnets placed at certain locations on the wheel 180 to determine the position of the wheel 180. In other embodiments, the position sensor may be an optical sensor or the like.

The method 385 further includes retracting, using the cam and follower mechanism 230, the holding pin 225 to drop the supplement on to the platform 320 (or for example, a verification system that verifies that an expected supplement (e.g., correct, single, and unbroken supplement) is delivered) (at block 410). Referring to FIGS. 6 and 8, as the scooping member 185 is rotated past the top portion of the wheel 180, the follower 240 corresponding to the scooping member 185 encounters the cut-off portion 250 of the cam 235. The follower 240 is then retracted, which retracts the holding pin 225 away from the circumference of the inward projection 215 of the scooping member 185. As the holding pin 225 is retracted, the supplement drops from the scooping member 185 on to the platform 320. The scooping member 185 may be shaped to include a curved portion at a radially inward portion of the scooping member 185. The curved portion pushes the supplement away from the wheel 180 and onto the platform 320 when the supplement is released by the holding pin 225. Accordingly, the method 385 delivers a single supplement to the platform 320.

FIG. 15 is a flowchart illustrating one example method 415 of dispensing supplements from the cartridge 155. As illustrated in FIG. 15, the method 415 includes rotating the wheel 180 to deliver a supplement to the shuttle system 300 (at block 420). For example, the electronic processor 370 executes the method 385 of FIG. 14 to rotate the wheel and deliver the supplement to the shuttle system 300.

The method 415 further includes determining whether only a single unbroken supplement is delivered to the shuttle system 300 (at block 425). This may also be referred to as singulation verification. The electronic processor 370 controls the camera system 305 to acquire an image of contents of the platform 320. The mirror 345 reflects the contents of platform 320 to the camera 340, which captures the image. The camera 340 provides the captured image to the electronic processor 370 for verification. The electronic processor 370 may use image recognition techniques on the captured image to ensure that only a single unbroken supplement is delivered to the shuttle system 300. Example image recognition techniques are described in U.S. Patent Application Publication No. 2018/0091745, the entire contents of which are hereby incorporated by reference.

When the electronic processor 370 determines that more than one supplement has been delivered to the shuttle system 300 or that a broken supplement has been delivered to the shuttle system 300, the method 415 includes returning the contents of the shuttle system 300 to the reservoir 170 (at block 430). The electronic processor 370 controls the shuttle drive 330 to move the shuttle 325 from the platform 320 to a first opening (e.g., the first position). The shuttle 325 returns the contents from the platform 320 to the reservoir 170 through the first opening. The method 415 returns to block 420 to deliver the next supplement to the shuttle system 300.

When the electronic processor 370 determines that only one unbroken supplement has been delivered to the shuttle system 300, the method 415 includes determining whether the correct supplement is delivered to the shuttle system 300 (at block 435). As described above, the electronic processor 370 may use the above incorporated image recognition techniques to determine whether the correct type of supplement has been delivered to the shuttle system 300.

When the electronic processor 370 determines that the incorrect type of supplement is delivered to the shuttle system 300, the method 415 moves to block 430 to return the contents of the shuttle system 300 to the reservoir 170, as described above. Accordingly, in blocks 410 and 420, the method 415 is determining whether an expected supplement is delivered to the shuttle system 300. In some embodiments, determining whether an expected supplement is delivered may include only one of the blocks 425 or 435 or the blocks 425 and 435 may be performed in a different order. In other embodiments, rather than checking for whether a single unbroken supplement is delivered to the shuttle system 300, determining whether an expected supplement may include determining whether a correct type of supplement is delivered to the shuttle system 300 regardless of the number of supplements delivered to the shuttle system 300. In yet other embodiments, determining whether an expected supplement may include determining whether a correct number of supplements is delivered to the shuttle system 300.

When the electronic processor 370 determines that the correct type of supplements is delivered to the shuttle system 300, the method 415 includes delivering the supplement to the packaging unit 110 (at block 440). The electronic processor 370 controls the shuttle drive 330 to move the shuttle 325 from the platform 320 to a second opening (e.g., the second position). The shuttle 325 delivers the supplement from the platform 320 to the packaging unit 110 through the second opening, the conduit 335, and the dispensing opening.

The method 415 also includes verifying the delivery of the supplement to the packaging unit 110 (at block 445). The pill sensor 362 detects whether or not a pill was dispensed through the conduit 335 and provides indicating signals to the electronic processor 370. The pill sensor 362 may detect a supplement in any form (e.g., capsule, tablet, gummy, and the like). When the electronic processor 370 determines that a supplement was delivered to the packaging unit 110, the method 415 returns to block 420 to deliver the next supplement. When the electronic processor 370 determines that a supplement was not delivered to the packaging unit 110, the electronic processor 370 sends an interrupt to the control system of the automatic packager 100 and returns to block 420 to re-deliver the supplement.

An example cartridge 155 and cartridge mechanism 160 are described in U.S. Pat. No. 10,583,941 filed on Oct. 15, 2018 and granted on Mar. 10, 2020, entitled "UNIVERSAL FEED MECHANISM FOR AUTOMATIC PACKAGER," the entire contents of which are hereby incorporated by reference.

Figure 16:
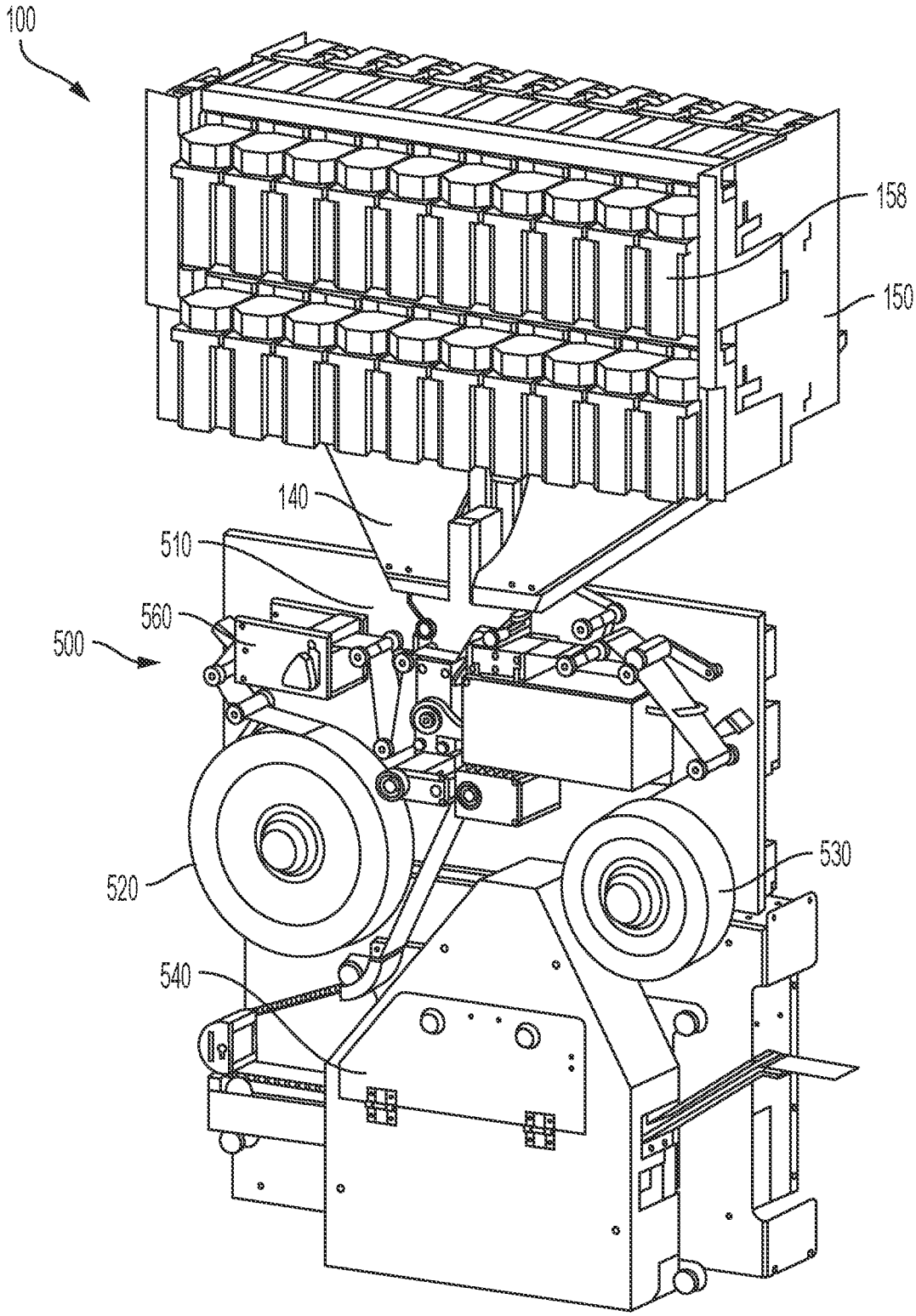
FIG. 16 is a perspective view of a strip packager used as a packaging unit of the automatic packager of FIG. 1 in accordance with some embodiments.

FIG. 16 illustrates one example embodiment of a strip packager 500 that may be used as the packaging unit 110. In the example illustrated, the strip packager 500 includes a chute 140, a receptacle 510, two feed stock rolls 520, 530, a take-up roll, and a verification system 540. The universal feed cassette 105 is placed on top of the chute 140. The chute 140, or chute, includes a plurality of discrete tracks corresponding to each of the cartridges 155 (particularly, a conduit of each cartridge 155) mounted on the chute 140. The tracks are independent channels that together form the chute 140. The tracks direct supplements from the universal feed cassette 105 toward packaging equipment of the strip packager 500. Conduits of the cartridges 155 align with holes in the chute 140 such that supplements slide down the chute 140 toward the packaging equipment. The tracks isolate the supplements from each other as the supplements slide down the chute 140 to the receptacle 510.

The receptacle 510 collects the supplements from the chute 140. After the supplements pass through to the receptacle 510, the supplements are sandwiched between two strips of material (e.g., plastic, paper, etc.) from the feed stock rolls 520, 530. The first feed roll 520 may be made of a first material that is white in color (e.g., a translucent material). The second feed roll 530 may be made of a second material that is clear (e.g., a transparent material) to allow a user to look through the pouch to see the supplements inside the pouch. The two strips of material are then heat sealed together to form a pouch for the supplements. In some embodiments, the strip packager 500 may include a single feed stock roll having a single strip of material that is folded and/or heat sealed to form pouches. Once filled and sealed, the pouches are wrapped around the take-up roll to create a single spool of pouches in the spooling unit 115. The spool may correspond to supplements requested by a particular consumer or a particular facility. In other embodiments, the pouches may be cut and separated as they are filled, rather than spooled onto the take-up roll continuously. The pouches are dispensed through, for example, a dispenser or dispensing port.

In some embodiments, the strip packager 500 may include a printer 560 to print a consumer's name, the date, the amount and type of supplements contained within, a barcode, and/or other indicia on the pouches as the pouches are formed. The printer 560 may be, for example, a thermal printer. In other embodiments, the printer 560 may include an ink ribbon or an ink jet. In addition, the strip packager 500 may include a verification system 540 to monitor and check the pouches as they are spooled onto the take-up roll or dispensed.

Figure 17:
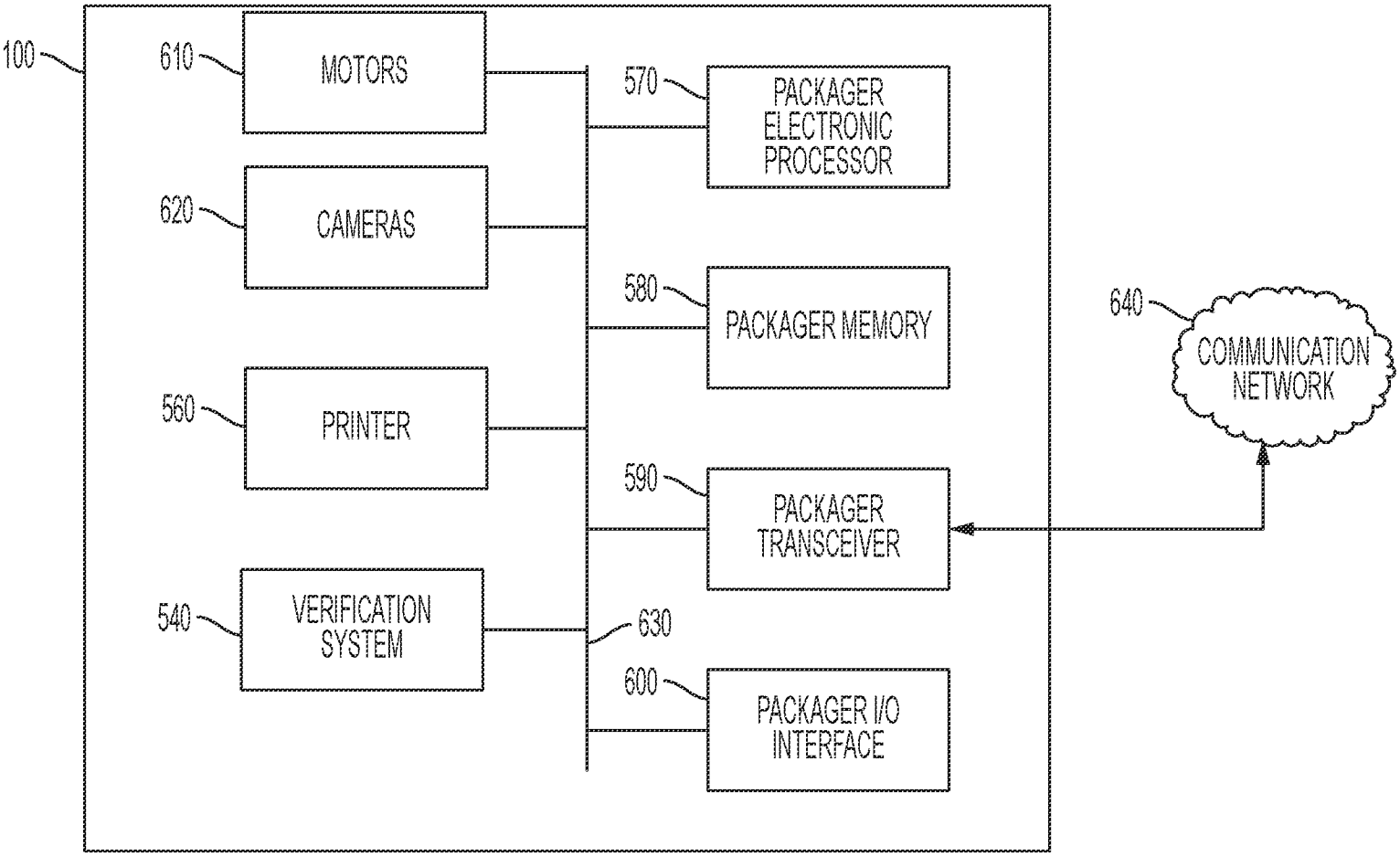
FIG. 17 is a schematic of the automatic packager of FIG. 1 in accordance with some embodiments.

FIG. 17 schematically illustrates one embodiment of the automatic packager 100. The automatic packager 100 controls operations of the feed stock rolls 520, 530 to release and form a supplement pouch, and controls when the active cartridges 155 positioned on the chute 140 are operated.

In the example illustrated, the automatic packager 100 includes a packager electronic processor 570, a packager memory 580, a packager transceiver 590, a packager input/output interface 600, the motors 610, the cameras 620, the printer 560, and the verification system 540. The packager electronic processor 570, the packager memory 580, the packager transceiver 590, the packager input/output interface 600, the motors 610, the cameras 620, the printer 560, and the verification system 540 communicate over one or more control and/or data buses (e.g., a communication bus 630). FIG. 17 illustrates only one exemplary embodiment of the automatic packager 100. The automatic packager 100 may include more or fewer components and may perform functions other than those explicitly described herein.

The packager electronic processor 570 and the packager memory 580 may be implemented similar to the electronic processor 370 and the memory 375 respectively, as described above. The packager transceiver 590 enables communication from the automatic packager 100 to the communication network 640. In other embodiments, the packager transceiver 590 may include separate transmitting and receiving components, for example, a transmitter and a receiver. The automatic packager 100, through the communication network 640, may communicate with the universal feed cassette 105.

As noted above, the automatic packager 100 may include the packager input/output interface 600 (or more commonly referred to as a user interface). The packager input/output interface 600 may include one or more input mechanisms (e.g., a touch screen, a keypad, a button, a knob, and the like), one or more output mechanisms (e.g., a display, a printer, a speaker, and the like), or a combination thereof. The packager input/output interface 600 receives input from the input devices actuated by a user, and provides output to the output devices with which a user interacts. In some embodiments, as an alternative or in addition to managing inputs and outputs through the packager input/output interface 600, the automatic packager 100 may receive user inputs, provide user outputs, or both by communicating with an external device, such as a console computer, over a wired or wireless connection.

One advantage of the cartridges 155 is that the cartridges 155 significantly reduce the packaging time compared to prior cartridges. Some prior cartridges had to be manually filled one supplement at a time by a user. In contrast, the user may simply dump supplements from a bulk container into the cartridge 155 and place the cartridge 155 in the universal feed cassette 105. The automatic packager 100 then retrieves supplements from the cartridge 155. The user may then use the funnel extension 175 to keep replenishing the cartridges 155 as the supplements are being packaged without having to remove the cartridges 155 from the universal feed cassette 105 and without having to introduce a delay in the process for refilling.

In the example illustrated in FIGS. 15 and 16, the automatic packager 100 is a strip packager. An example strip packager is described in U.S. Patent Application Publication No. 2013/031891 and U.S. Patent Application Publication No. 2017/0015445, the entire contents of both of which are hereby incorporated by reference. In other embodiments, other suitable packaging units, including strip packagers, blister card packagers, and the like, may also or alternatively be used.

The automatic packager 100 may be deployed in a high-volume supplement packaging facility. The supplement packaging facility has a plurality of automatic packagers 100 (for example, 10-30 packagers) provided on a packaging floor. The packaging floor also includes large containers that store supplements. Supplements may be fed to the large containers using an automated mechanism. Packaging technicians on the packaging floor may use jugs or other portable containers to pick up supplements from the large containers and top up the cartridges 155. Specifically, in one example, the user refills a gallon jug using the large containers and walks by the automatic packagers 100 to refill the cartridges 155 as needed.

Figure 18:
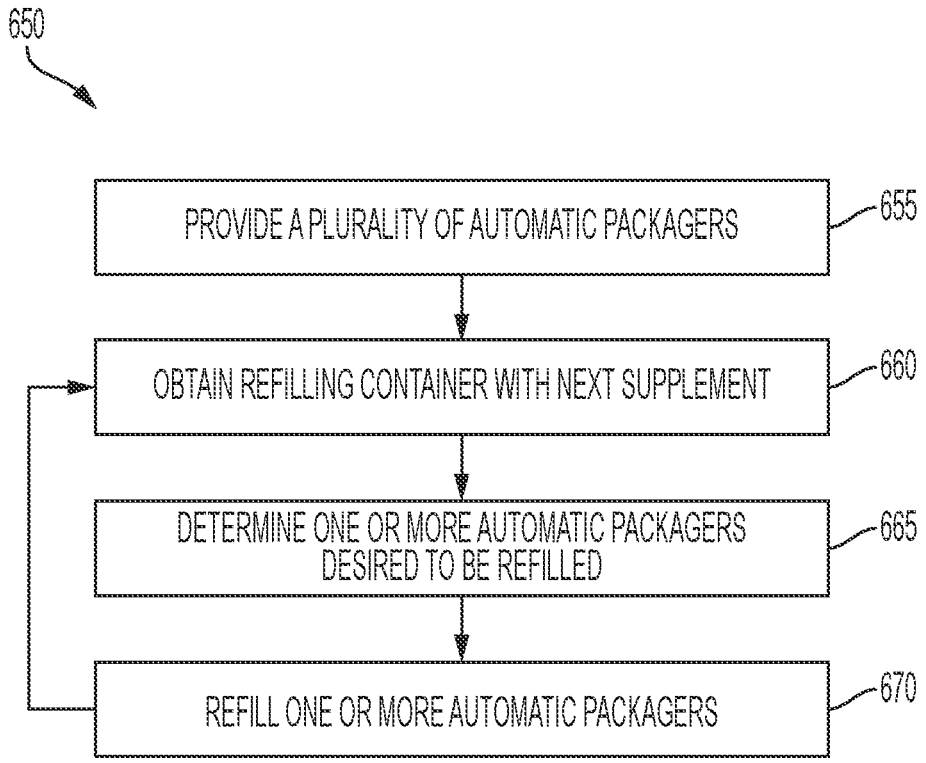
FIG. 18 is a flowchart of a method for refilling automatic packagers of FIG. 1 in accordance with some embodiments.
Figure 19:
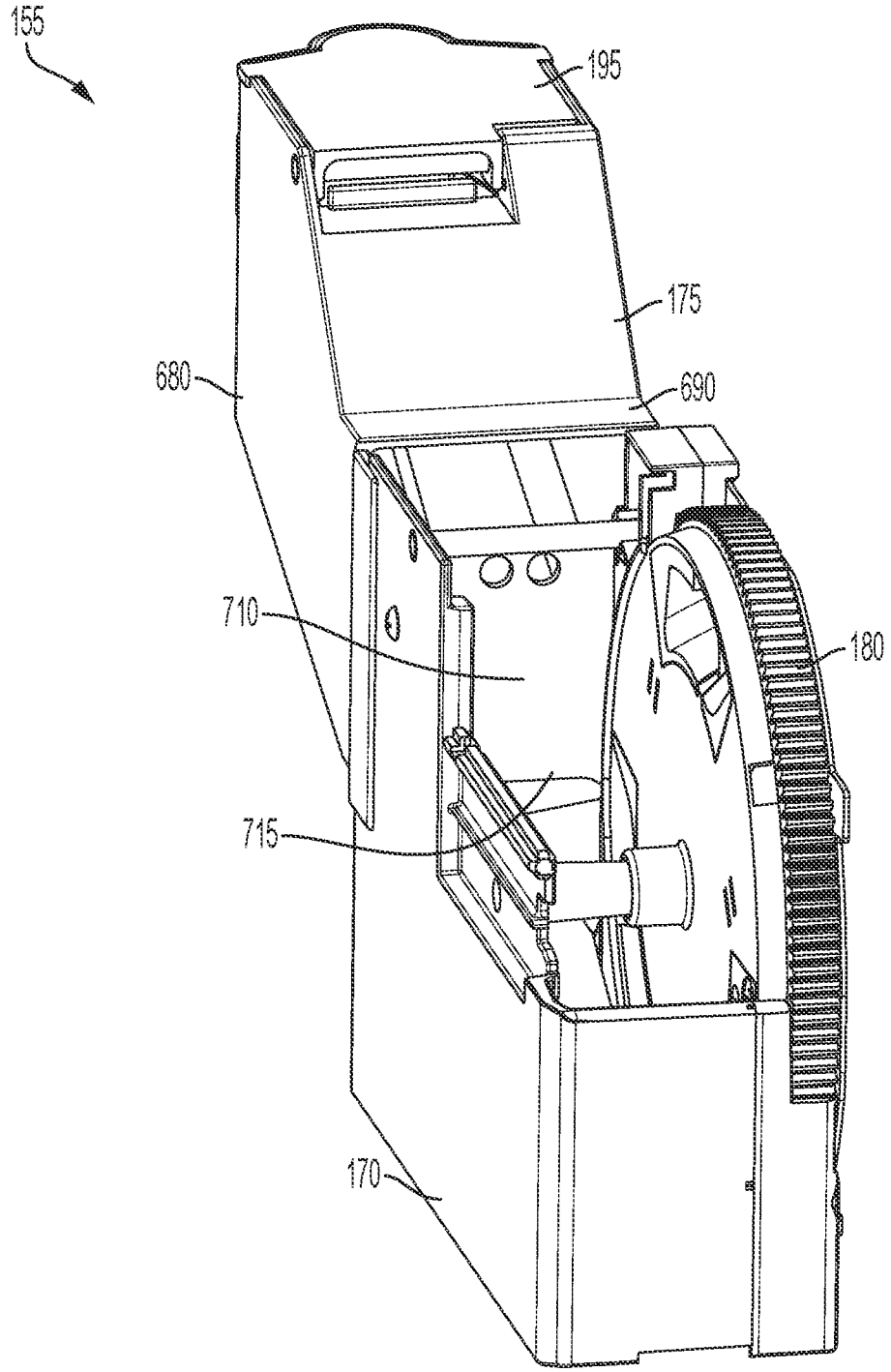
FIG. 19 is a front perspective view of a cartridge of the universal feed cassette of FIG. 2 in accordance with some embodiments.
Figure 20:
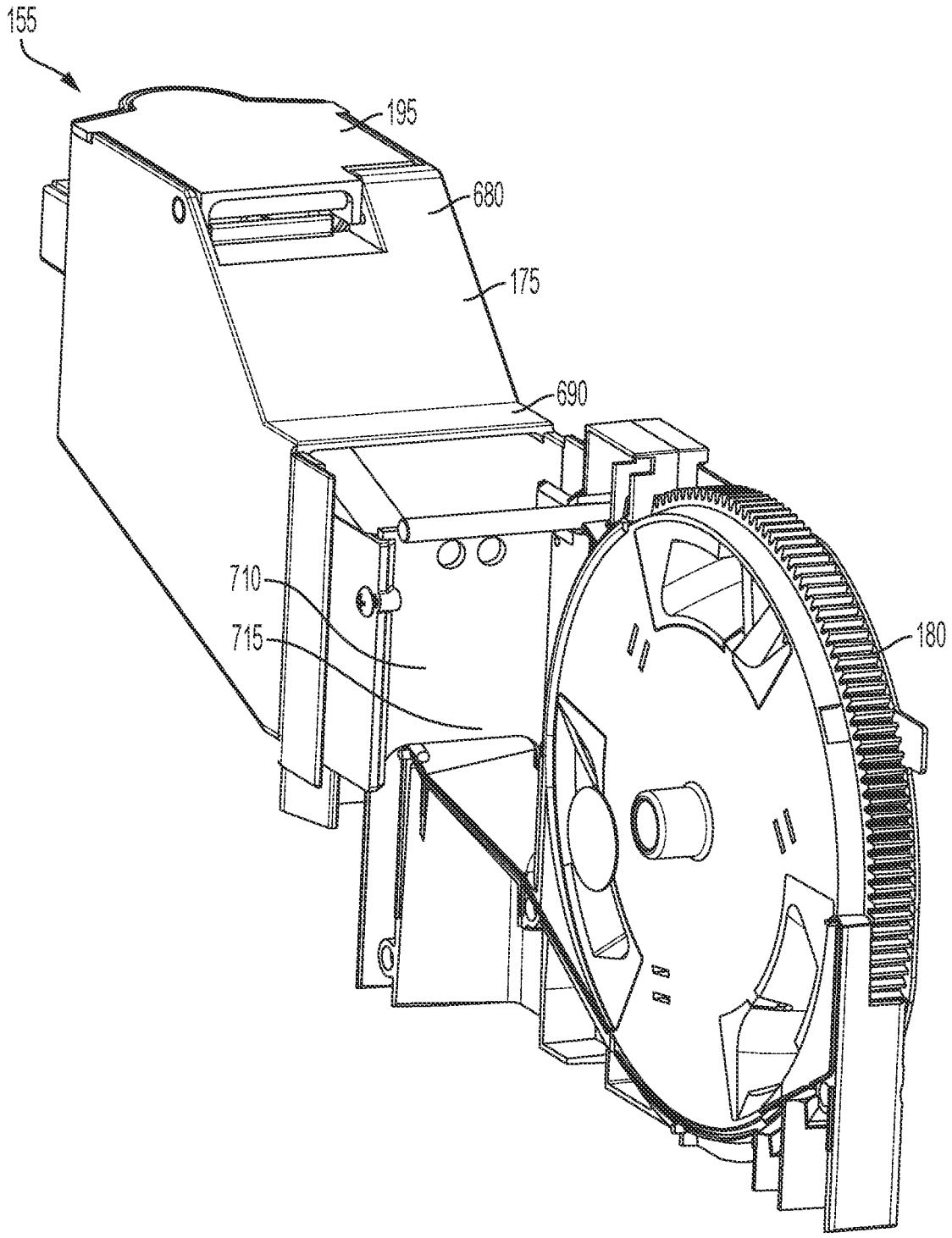
FIG. 20 is a front perspective view of the cartridge of FIG. 19 with a reservoir removed in accordance with some embodiments.
Figure 21:
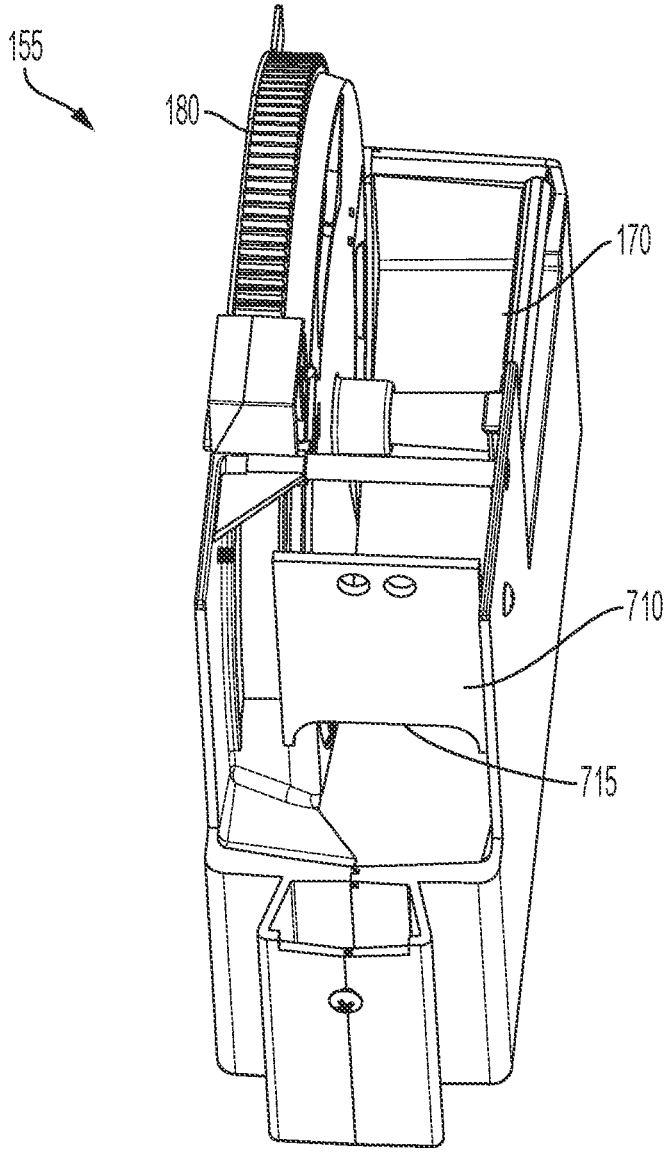
FIG. 21 is a rear perspective view of the cartridge of FIG. 19 in accordance with some embodiments.

FIG. 18 is a flowchart of an example method 650 for refilling the automatic packagers 100 on a packaging floor. The method 650 includes providing a plurality of automatic packagers 100 (at block 655). For example, twenty (20) automatic packagers 100 are provided on a packaging floor to package supplements per customer specifications. Specifically, the customer provides an order request, for example, through an order portal of the packaging facility. The automatic packagers 100 process customer orders received through the order portal. As the automatic packagers 100 are processing the orders, the supplements received in the cartridges 155 are depleted during packaging.

The method 650 includes obtaining a refilling container with next supplement (at block 660). During a first instance, a packaging technician uses a refilling jug to obtain a first supplement from a large container including the first supplement. The refilling container is used by the packaging technician to transport the supplements from the large container to the automatic packagers 100.

The method 650 further includes determining one or more automatic packagers 100 desired to be refilled of the plurality of automatic packagers 100 (at block 665). As the packaging technician moves through the packaging floor, the packaging technician inspects each automatic packager 100 to determine whether the obtained supplement is desired to be refilled for that automatic packager 100. Specifically, the packaging technician visually inspects the funnel extension 175 of the cartridge 155 containing the obtained supplement to determine whether the cartridge 155 is to be refilled. As discussed above, the funnel extension 175 may be made of clear plastic material such that the packaging technician may quickly visually inspect the level of supplements in the cartridge 155 without having to remove the cartridge 155 from the automatic packager 100. In some embodiments, the cartridge 155 in the same relative location of each automatic packager 100 (e.g., "cartridge #3") may include the same supplement so the packaging technician can simply inspect the cartridge 155 at that location in each automatic packager 100.

The method 650 includes refilling the one or more automatic packagers (at block 670). Upon determining that an automatic packager 100 of the plurality of automatic packagers 100 are desired to be refilled, the packaging technician may top off the corresponding cartridges 155 of the one or more automatic packagers using the refilling container. The packaging technician may refill the cartridges 155 up to a level indicated on the funnel extension 175 of the cartridge 155.

The method 650 proceeds to block 660 to repeat blocks 660, 665, 670 for each supplement being packaged by the plurality of automatic packagers 100. For example, if the automatic packagers 100 are each packaging 40 different supplements, the packaging technician may repeat this process 40 times. In addition, in some embodiments, multiple packaging technicians may be performing this process simultaneously. In such situations, each technician may be responsible for certain supplements and/or cartridges (e.g., a first technician may be responsible for monitoring and refilling cartridge #1 through cartridge #20, while a second technician may be responsible for monitoring and refilling cartridge #21 through cartridge #40). In some scenarios, the packaging technician(s) may know particular supplements are used (e.g., packaged) more often than others and may repeat the process more frequently for those cartridges than for other cartridges.

FIGS. 19-26 illustrate an example embodiment of the cartridge 155 having a modified funnel extension 175. The funnel extension 175 extends outward and upward from the reservoir 170. The funnel extension 175 includes an opening 195 at the top of the funnel extension 175, a first portion 680 that diagonally downward from the opening 195, and a second portion 690 that extends laterally from the first portion 680 to the reservoir 170. In the illustrated embodiment, the opening 195 is covered by a lid. The lid may be moved (e.g., pivoted) open to provide access to the opening. When a user refills the cartridge 155, the medical products flow through the opening 195, the first portion 680, and the second portion 690 into the bottom portion of the reservoir 170. The funnel extension 175 includes an opening at the end of the second portion 690 that allows the medical products poured into the funnel extension 175 to flow to the reservoir 170.

With reference to FIGS. 19-23, the cartridge 155 also includes a weir 710 provided between the funnel extension 175 and the reservoir 170, for example, at the opening of the second portion 690. The illustrated weir 710 is a plate. The weir 710 allows a steady flow of supplements or medications into the reservoir 170 from the funnel extension 175. The weir 710 also prevents the supplements or medications from piling up around the wheel 180. In some embodiments, the weir 710 may be provided within the funnel extension 175 or within the reservoir 170. In some embodiments, the weir 710 is provided immediately adjacent the wheel 180 within the funnel extension 175 (shown in FIG. 20).

Figure 22:
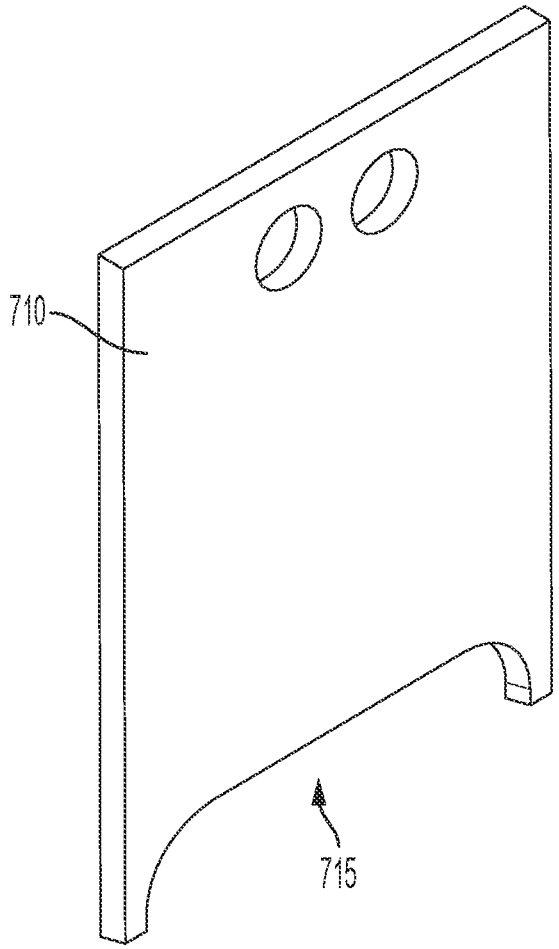
FIG. 22 is a perspective view of a weir of the cartridge of FIG. 19 in accordance with some embodiments.
Figure 23:
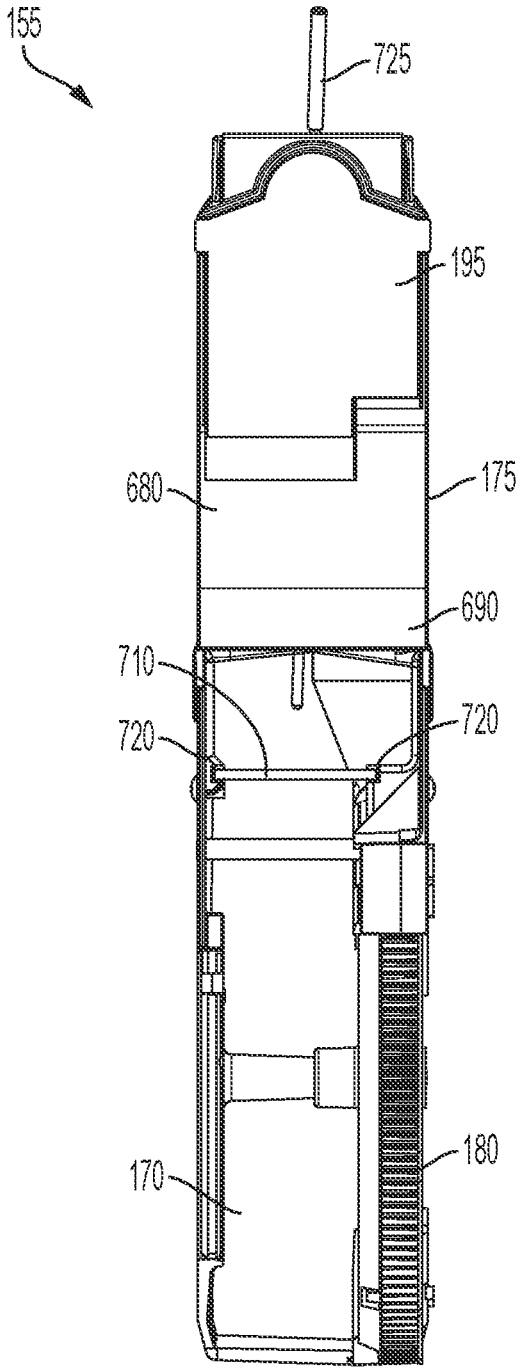
FIG. 23 is a top plan view of the cartridge of FIG. 19 in accordance with some embodiments.

With reference to FIG. 22, the weir 710 may include a rectangular shape having an opening 715 at the bottom. The opening 715 is designed to control the flow of supplements or medications from the funnel extension 175 into the reservoir 170. With reference to FIG. 23, the funnel extension 175 includes grooves 720 on either side of the funnel extension 175. The grooves 720 are sized to receive a width of the weir 710 such that the weir 710 can be received in the funnel extension 175 by sliding the weir 710 downwards into the grooves 720. A pharmacy may carry several weirs 710 having differently sized openings 715 to be used for supplements or medications of different sizes. A weir 710 having a smaller opening 715 is used in a cartridge 155 for smaller supplements and medications, while a weir 710 having a larger opening 715 is used in a cartridge 155 for larger supplements and medications. In some embodiments, a weir 710 having a larger opening is used for supplements and medications having a lighter weight (for example, below a threshold weight of 1 gm, 0.5 gms, and the like) regardless of the size of the supplements and medications. Additionally, the weir 710 can be easily removed and replaced from the funnel extension 175 for regular cleaning. In some embodiments, each weir 710 may include identification markings to help a user identify the different configurations of weirs.

Figure 24:
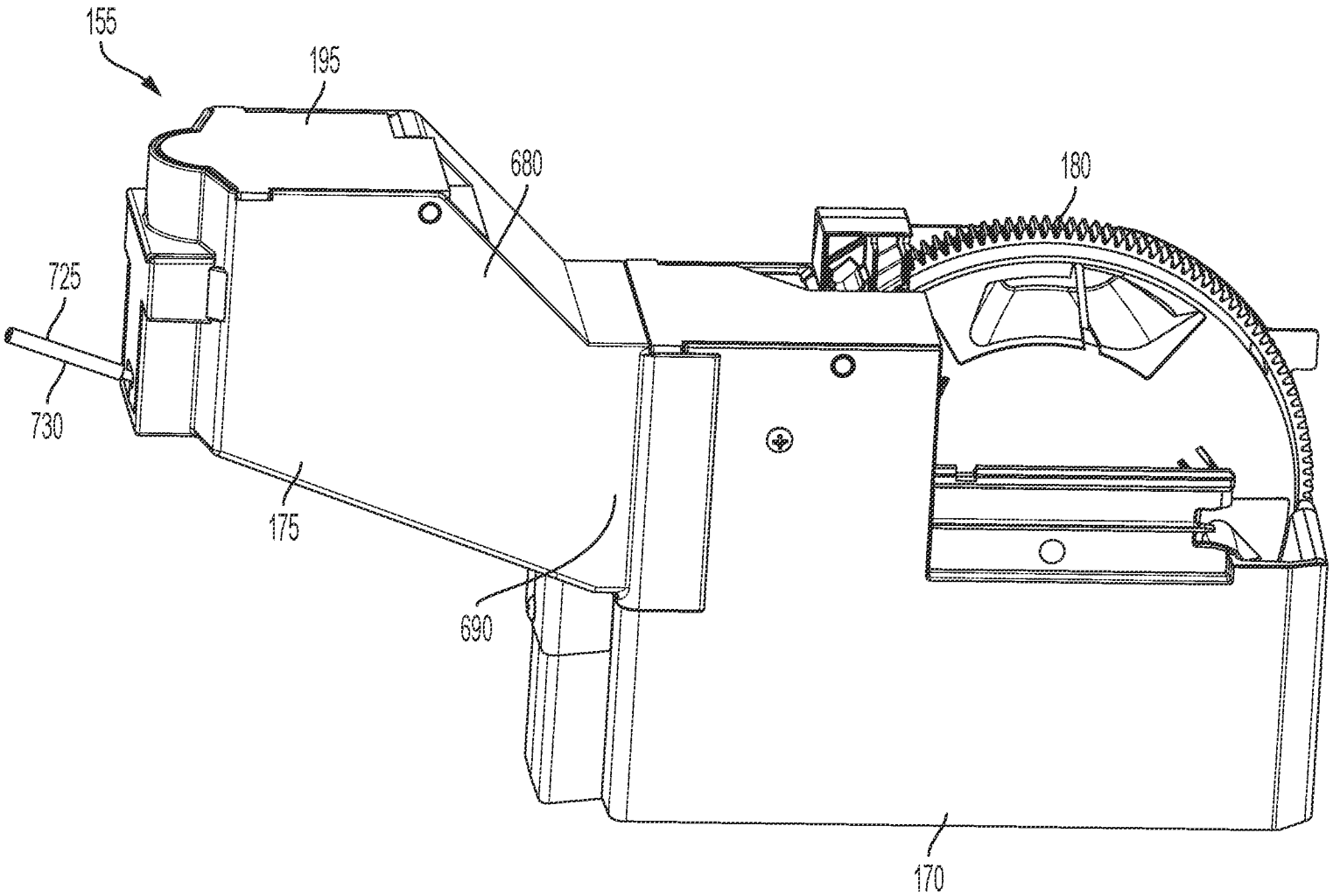
FIG. 24 is a perspective view of the cartridge of FIG. 19 in accordance with some embodiments.
Figure 25:
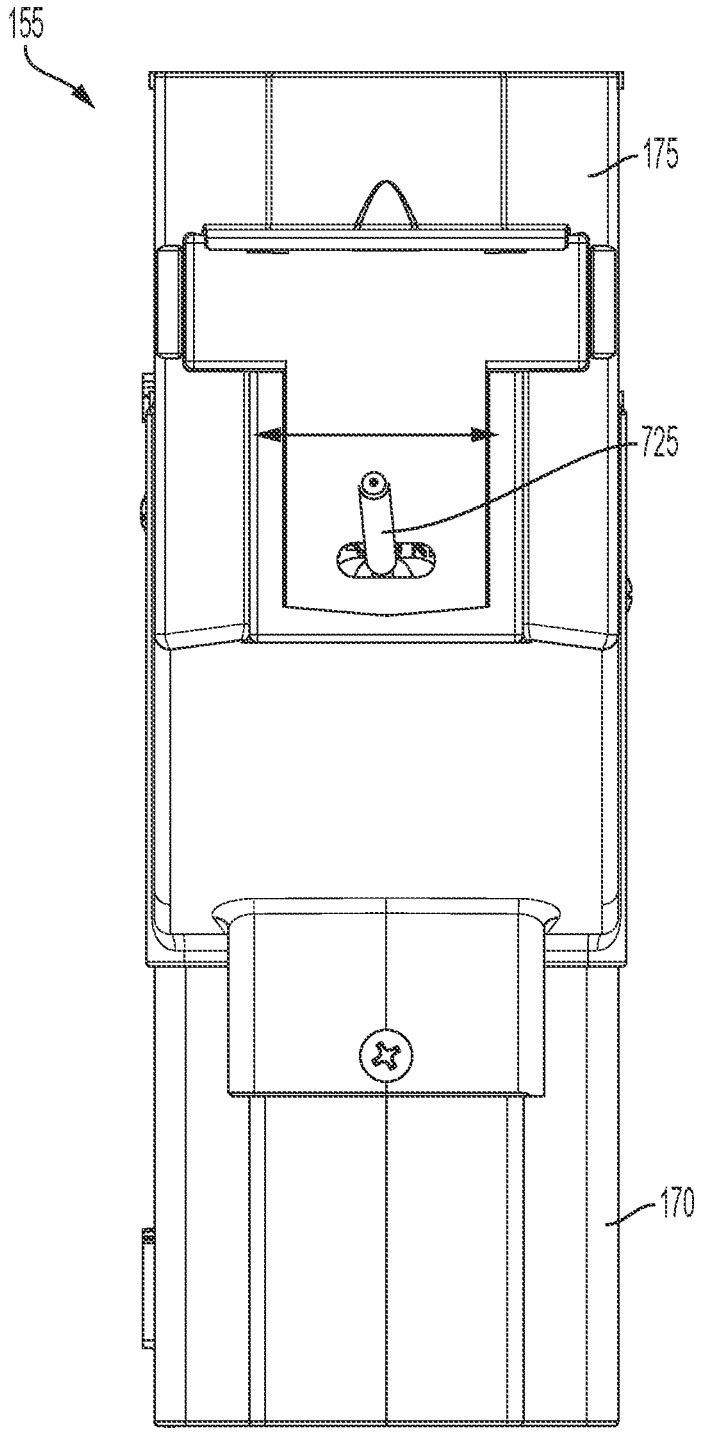
FIG. 25 is a rear plan view of the cartridge of FIG. 19 in accordance with some embodiments.
Figure 26:
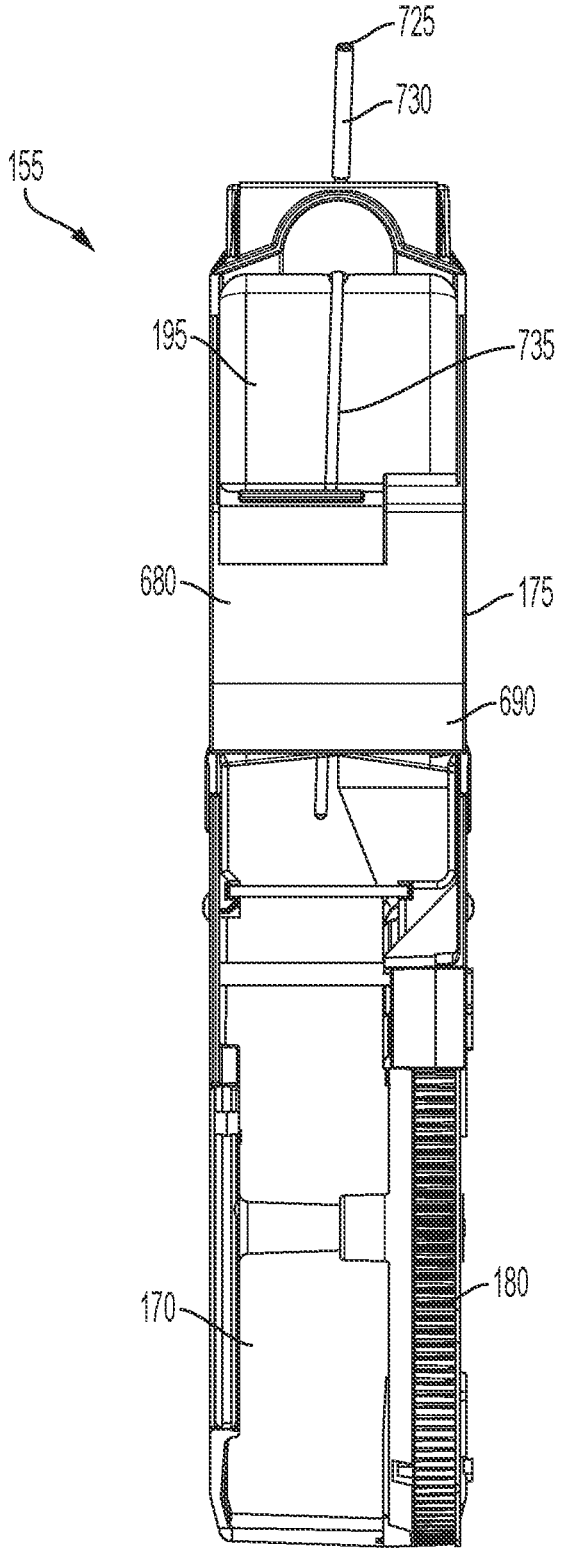
FIG. 26 is a top plan view of the cartridge of FIG. 19 in accordance with some embodiments.

With reference to FIGS. 24-26, the cartridge 155 may additionally include a stir rod 725. The stir rod 725 is received in and fixed to the funnel extension 175. The stir rod 725 can be used to agitate the supplements or medications within the funnel extension 175 to stimulate a flow into the reservoir 175. The stir rod 725 includes a holder 730 and a rod 735. The holder 730 is provided outside the funnel extension 175 around a rear portion of the funnel extension 175. The rod 735 is substantially provided within the funnel extension 175.

The stir rod 725 is pivotably fixed to the funnel extension 175 with a pivoted portion provided near the junction of the holder 730 and the rod 735. With reference to FIG. 25, the stir rod 725 is pivoted between a left and right position to agitate the supplements or medications within the funnel extension 175. The holder 730 is provided outside the funnel extension 175 to be held by a user to move the stir rod 725. The rod 735 is provided within the funnel extension and extends from the rear portion of the funnel extension 175 to substantially close to the weir 710. The stir rod 725 is angled downward to follow the flow direction of the supplements or medications within the funnel extension 175.

In other embodiments, the cartridge 155 may include other types of agitation mechanisms to stimulate flow into the reservoir 175. For example, the cartridge 155 may include an auger or rotor, a vibration motor, a plunger, and the like.

Thus, the invention provides, among other things, an automatic packager for supplements.

What is claimed is:

1. A cartridge for an automatic packager, the cartridge comprising:

a reservoir for storing a plurality of medical products;

a wheel including a bottom portion placed in the reservoir, the wheel being rotatable with respect to the reservoir;

a scooping member provided on the wheel to rotate with the wheel and singulate a medical product from the reservoir; and a funnel extension coupled to the reservoir and extending outward and upward from the reservoir, the funnel extension extends from the reservoir along an insertion axis of the cartridge, the funnel extension including a first opening at a top of the funnel extension, a first portion extending downward from the first opening, a second portion extending diagonally to the reservoir, and a second opening at a reservoir end of the second portion; and a stir rod pivotably fixed to the funnel extension and configured to be moved to agitate the medical products in the funnel extension, wherein the stir rod extends longitudinally through the funnel extension from the first portion to the second opening.

2. The cartridge of claim 1, further comprising a spout portion provided above the reservoir and configured to guide medical products to the reservoir.

3. The cartridge of claim 2, wherein the funnel extension extends outward and upward from the spout portion.

4. The cartridge of claim 1, wherein the funnel extension further comprises a third portion extending laterally from the second portion to the reservoir.

5. The cartridge of claim 1, further comprising:

a weir provided between the funnel extension and the reservoir, wherein the weir is provided adjacent the wheel, and wherein the weir is rectangular with a weir opening at a bottom of the weir.

6. The cartridge of claim 1, further comprising:

a throttle provided at the second opening, the throttle having a medical products opening sized to allow a limited number of medical products to pass through at a time.

7. The cartridge of claim 6, wherein the throttle further comprises:

a rotating plate; and an actuation mechanism configured to rotate the throttle to transfer the medical products from the funnel extension to the reservoir.

8. The cartridge of claim 1, wherein the scooping member includes an inward projection extending inward into the wheel, and wherein the reservoir includes a curved shape to direct the plurality of medications toward the inward projection when the scooping member is within the reservoir.

9. The cartridge of claim 8, wherein the scooping member includes a stopper along a circumferential end of the inward projection to hold the medication as the wheel is rotated, the cartridge further comprising a holding pin extending through the wheel and the scooping member, wherein the medication is singulated by holding a single medication between the holding pin, the stopper, and the circumferential end of the scooping member.

10. The cartridge of claim 1, wherein the first opening is on an opposite side of the funnel extension as the reservoir.

11. The cartridge of claim 1, wherein the funnel extension includes a fourth portion extending between the first portion and the second portion, the fourth portion including a curved wall that connects the first portion to the second portion.

12. The cartridge of claim 1, wherein the first opening and the second opening are perpendicular to one another.

13. The cartridge of claim 1, wherein the first opening is larger than the second opening.

14. An automatic packager for packaging medical products, the automatic packager comprising:

a universal feed cassette including a housing, a plurality of cartridge slots within the housing, and a plurality of dispensing openings provided on a bottom of the housing corresponding to the plurality of cartridge slots; and a packaging unit including chutes in communication with the plurality of dispensing openings, wherein each of the plurality of cartridge slots are configured to receive a cartridge, each cartridge including a reservoir for storing a plurality of medical products;

a wheel including a bottom portion placed in the reservoir, the wheel being rotatable with respect to the reservoir;

a scooping member provided on the wheel to rotate with the wheel and singulate a medical product from the reservoir; and a funnel extension coupled to the reservoir and extending outward and upward from the reservoir.

15. The automatic packager of claim 14, wherein the universal feed cassette includes up to forty cartridge slots.

16. The automatic packager of claim 14, wherein the plurality of cartridge slots are arranged in a multi-level formation such that a second row of cartridge slots is provided above a first row of cartridge slots.

17. The automatic packager of claim 16, further comprising:

a first separating platform provided between the first row of cartridge slots and the second row of cartridge slots.

18. The automatic packager of claim 14, further comprising an opening on a front side of the housing, wherein the cartridge is received through the opening.

19. The automatic packager of claim 14, further comprising a plurality of cartridge mechanisms, one for each of the plurality of cartridge slots fixed to the housing.

20. The automatic packager of claim 19, wherein each cartridge mechanism further comprises:

a platform configured to receive a medication from a corresponding cartridge;

a camera system;

an electronic processor coupled to the camera system, the electronic processor configured to control the camera system to capture an image of the platform;

determine whether an expected medication was delivered to the platform based on the image;

in response to determining that the expected medication is delivered to the platform, dispense the medication from the cartridge; and in response to determining that the expected medication is not delivered to the platform, return the medication to the cartridge.

21. The automatic packager of claim 14, wherein the cartridge further comprises a spout portion provided above the reservoir and configured to guide medical products to the reservoir.

22. The automatic packager of claim 21, wherein the funnel extension extends outward and upward from the spout portion.

23. The automatic packager of claim 14, wherein the funnel extension further comprises:

an opening at a top of the funnel extension;

a first portion extending diagonally downward from the opening; and a second portion extending laterally from the first portion to the reservoir.

24. The automatic packager of claim 14, wherein the cartridge further comprises:

a weir provided between the funnel extension and the reservoir.

25. The automatic packager of claim 14, wherein the cartridge further comprises:

a stir rod pivotably fixed to the funnel extension and configured to be moved to agitate the medical products in the funnel extension.

26. The automatic packager of claim 14, wherein the cartridge further comprises:

a first opening at a top of the funnel extension;

a first portion extending downward from the opening;

a second portion extending diagonally from the first portion to the reservoir; and a second opening at a reservoir end of the second portion.

27. The automatic packager of claim 14, wherein the scooping member includes an inward projection extending inward into the wheel, and wherein the reservoir includes a curved shape to direct the plurality of medications toward the inward projection when the scooping member is within the reservoir.

28. A method of filling medical products in an automatic packager, the automatic packager including a universal feed cassette having a housing, a plurality of cartridge slots within the housing, and a plurality of dispensing openings provided on a bottom of the housing corresponding to the plurality of cartridge slots, and a packaging unit having chutes in communication with the plurality of dispensing openings, the method comprising:

inserting a cartridge into one of the plurality of cartridge slots, the cartridge including a reservoir for storing a plurality of medical products, a wheel having a bottom portion placed in the reservoir and being rotatable with respect to the reservoir, a scooping member provided on the wheel to rotate with the wheel and singulate a medical product from the reservoir, and a funnel extension coupled to the reservoir and extending outward and upward from the reservoir; and filling the reservoir of cartridge with medical products by pouring the medical products into the funnel extension without removing the cartridge from the cartridge slot.

29. The method of claim 28, further comprising:

inserting a weir between the funnel extension and the reservoir to control a flow of the medical products between the funnel extension and the reservoir.

30. The method of claim 28, further comprising:

actuating a stir rod pivotably fixed to the funnel extension to agitate the medical products in the funnel extension.

31. The method of claim 28, further comprising:

providing a throttle between the funnel extension and the reservoir to control a flow of the medical products between the funnel extension and the reservoir.

* * * * *